US008920077B2

(12) United States Patent
Kruse

(10) Patent No.: US 8,920,077 B2
(45) Date of Patent: Dec. 30, 2014

(54) POST TENSIONED FOUNDATIONS, APPARATUS AND ASSOCIATED METHODS

(76) Inventor: Darin Kruse, Simi Valley, CA (US)

( * ) Notice: Subject to any disclaimer, the term of this patent is extended or adjusted under 35 U.S.C. 154(b) by 125 days.

(21) Appl. No.: 13/592,223

(22) Filed: Aug. 22, 2012

(65) Prior Publication Data

US 2013/0051927 A1 Feb. 28, 2013

Related U.S. Application Data

(60) Provisional application No. 61/526,192, filed on Aug. 22, 2011.

(51) Int. Cl.
*E02D 13/00* (2006.01)
*E02D 13/10* (2006.01)

(52) U.S. Cl.
CPC ..... *E02D 13/10* (2013.01)
USPC ..... 405/233; 405/239; 405/244

(58) Field of Classification Search
CPC ..... E02D 5/34; E02D 5/54; E02D 7/06
USPC ..... 405/233, 239, 240, 243, 244
See application file for complete search history.

(56) References Cited

U.S. PATENT DOCUMENTS

| | | | | |
|---|---|---|---|---|
| 1,805,265 | A * | 5/1931 | Taussig | 405/239 |
| 3,385,070 | A * | 5/1968 | Jackson | 405/243 |
| 3,464,216 | A * | 9/1969 | Turzillo | 405/239 |
| 3,937,607 | A | 2/1976 | Rodormer | |
| 4,108,154 | A | 8/1978 | Nelson | |
| 4,223,214 | A | 9/1980 | Dorian et al. | |
| 4,404,465 | A | 9/1983 | Miller | |
| 4,832,001 | A | 5/1989 | Baer | |
| 5,228,924 | A | 7/1993 | Barker et al. | |
| 5,249,892 | A | 10/1993 | Fox et al. | |
| 5,437,526 | A | 8/1995 | Herbst | |
| 6,354,766 | B1 | 3/2002 | Fox | |
| 6,425,713 | B2 | 7/2002 | Fox et al. | |
| 6,563,040 | B2 | 5/2003 | Hayden et al. | |
| 6,688,815 | B2 | 2/2004 | Fox | |
| 6,722,357 | B2 | 4/2004 | Shingleton | |
| 7,226,246 | B2 | 6/2007 | Fox | |
| 7,326,004 | B2 | 2/2008 | Wissmann et al. | |
| 7,413,159 | B2 | 8/2008 | Liang et al. | |
| D586,737 | S | 2/2009 | Shugar et al. | |
| 7,488,139 | B2 | 2/2009 | Wissmann | |
| 7,604,437 | B2 | 10/2009 | Wissmann et al. | |

(Continued)

FOREIGN PATENT DOCUMENTS

| | | |
|---|---|---|
| JP | 07-286327 | 10/1995 |
| WO | 2013/028797 | 2/2013 |

OTHER PUBLICATIONS

International Search Report dated Jan. 30, 2013 for International Application PCT No. PCT/US2012/051932.

(Continued)

*Primary Examiner* — Benjamin Fiorello
(74) *Attorney, Agent, or Firm* — K&L Gates LLP; Louis C. Cullman; Brian J. Novak

(57) ABSTRACT

Described herein are shallow post tensioned foundation systems for mounting light to medium weight structures. Methods of installation are also described. The systems, apparatus and methods described can reduce waste, increase efficiency and reduce cost and installation/construction time.

10 Claims, 29 Drawing Sheets

(56) References Cited

U.S. PATENT DOCUMENTS

| | | | | |
|---|---|---|---|---|
| 7,901,159 | B2 | 3/2011 | Fox | |
| 2004/0115011 | A1 | 6/2004 | Fox | |
| 2006/0088388 | A1* | 4/2006 | Wissmann et al. | 405/232 |
| 2007/0269273 | A1* | 11/2007 | Henderson | 405/239 |
| 2008/0193223 | A1 | 8/2008 | Wissmann et al. | |
| 2008/0245360 | A1 | 10/2008 | Almy et al. | |
| 2009/0032014 | A1 | 2/2009 | Meydbray | |
| 2009/0311050 | A1 | 12/2009 | Martin, Sr. | |
| 2010/0028087 | A1 | 2/2010 | Wissmann | |
| 2010/0089389 | A1 | 4/2010 | Seery et al. | |
| 2010/0178114 | A1 | 7/2010 | Reeves | |
| 2010/0329798 | A1 | 12/2010 | Maher et al. | |
| 2011/0020069 | A1* | 1/2011 | Richman | 405/244 |
| 2011/0052330 | A1 | 3/2011 | Wissmann et al. | |
| 2013/0048582 | A1 | 2/2013 | Kruse | |
| 2013/0048583 | A1 | 2/2013 | Kruse | |

OTHER PUBLICATIONS

Rammed Aggregate Pier® Systems: Overview. Geopier Foundation Company. Accessed Mar. 10, 2011. http://www.geopier.com/index.asp?id=71.

Rammed Aggregate Pier® Systems: Vertical Ramming Makes the Difference: Applications. Geopier Foundation Company. Accessed Mar. 10, 2011. http://www.geopier.com/index.asp?id=28.

Rammed Aggregate Piers. The Geopier® Construction Process. Geopier Foundation Company.

The Geopier® System: Geopier® Overview. Geopier Foundation Company. Accessed Mar. 10, 2011. http://www.geopier.com/index.asp?id=11.

The Impact® System: Impact® Overview. Geopier Foundation Company. Accessed Mar. 10, 2011. http://www.geopier.com/index.asp?id=64.

Kruse et al., Post Tesnsion Shallow Gravel Column (PTSGC) Reaction Plate Design. Cobalt Construction Company, 2011.

* cited by examiner

FIG. 4D
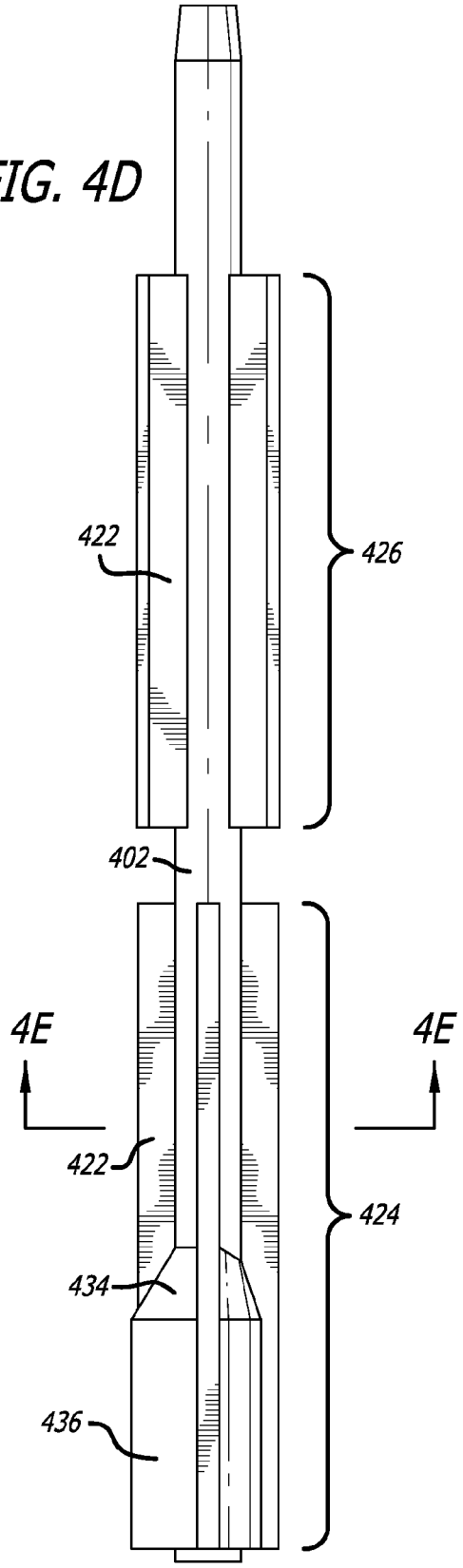
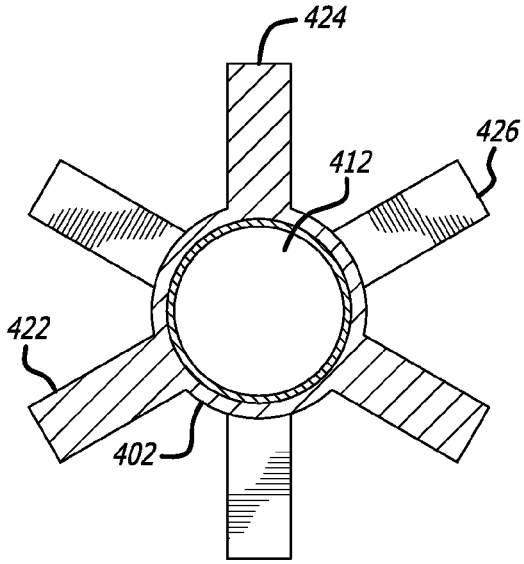
FIG. 4E

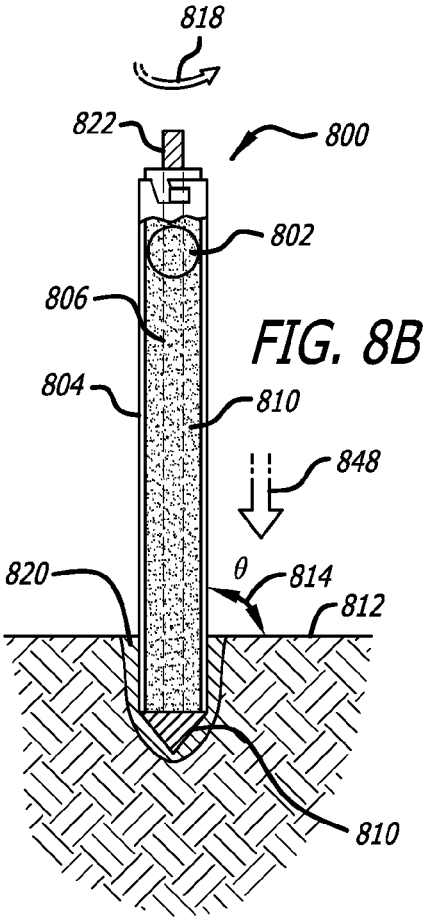
FIG. 8B
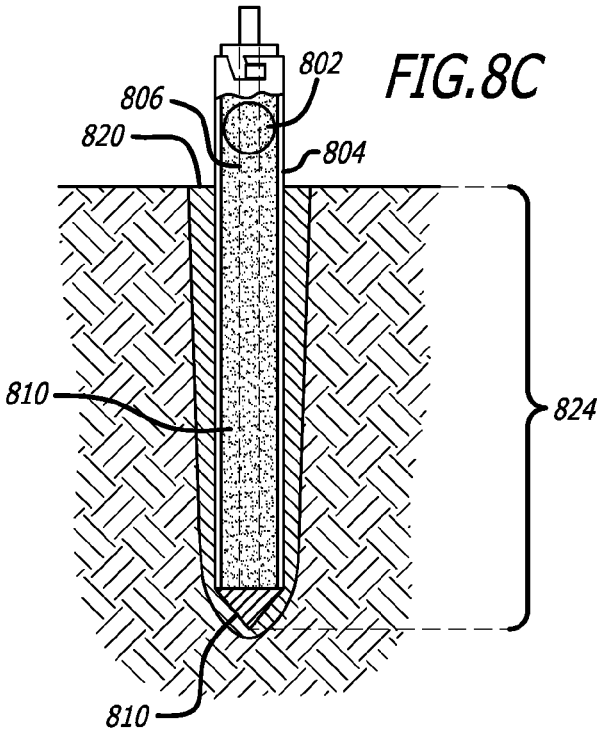
FIG.8C
FIG. 8D
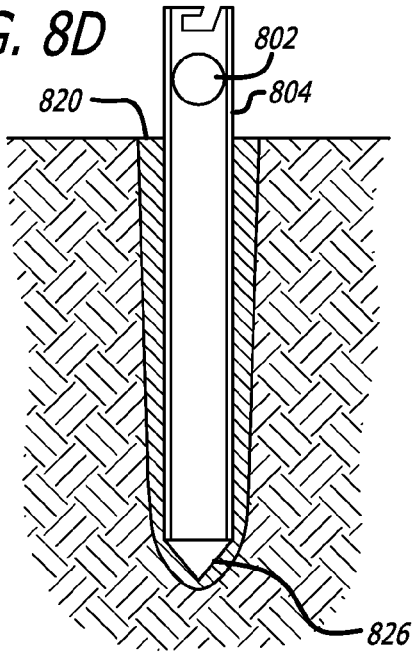

POST TENSIONED FOUNDATIONS, APPARATUS AND ASSOCIATED METHODS

CROSS-REFERENCE TO RELATED APPLICATIONS

The present application claims the benefit under 35 U.S.C. §119(e) to U.S. Provisional Application Ser. Nos. 61/526,192 filed Aug. 22, 2011, the entire disclosure of which is hereby incorporated by reference in its entirety.

FIELD

Described herein are post tensioned foundations that can be used in a variety of soil conditions. Apparatus and associated methods of installing the foundations are provided.

BACKGROUND

A goal in construction can be to reduce costs, labor requirements, material complexity and the like while attaining an improved final product. Further, in light of growing environmental concerns, construction methods that reduce global impact and are sustainable have become as important as, if not more important, than reducing costs.

Currently, most shallow foundations utilize designs requiring manufactured materials, such as concrete and steel, that are expensive, and in the case of steel piers, not immediately available to the job site. Both the foundation design and construction process can be costly and cumbersome due to a myriad of factors such as material and transportation costs, soil preparation, excavation, disposal costs, and time constraints stemming from specifications, manufacturing, and delivery impacts required for needed materials.

Also, in many cases, the soil beneath and around the current shallow foundation systems require conditioning and/or densification prior to construction. This ground improvement procedure can be very costly and time consuming. In cases where concrete foundations are specified, the existing soil must be excavated and disposed of prior to concrete placement. Additionally, once decommissioned, current shallow foundation systems require excavation, disassembly, disposal, and decommissioned site soil replacement and/or revegetation which may have a negative effect on the environment.

As such, there is a need in the construction art for shallow foundations that are cheaper than present methods, use readily available materials, and reduce the environmental impact of the construction project both during and after decommission and removal.

SUMMARY

Generally described herein are post tensioned foundation systems, methods of installing them, and apparatus used to install them. The post tensioned foundations described can be useful for anchoring light to medium weight structures and are cost effective, save time and/or are sustainable.

Also described are post tensioned foundation installation systems comprising: a mandrel including a first end and a second end, the first end including a compaction element and the second end including a power tool attachment section; a transversal rod guide conduit originating at the compaction element and terminating at or before the power tool attachment point; and an outer skin defining an aggregate feed cavity, wherein the outer skin includes at least one aggregate port.

Post tensioned foundation installation systems can include a casing having a hollow body with an interior diameter, a first end and a second end including at least one aggregate feed port; a mandrel comprising a gravel chute, a compaction element or striking sledge, a force transfer foot, and an outer diameter that fits within the interior diameter of the casing; and a transversal rod guide conduit at a reaction plate. The mandrel can also include a power tool attachment point at its second end.

Further described are post tensioned foundation installation devices comprising a mandrel including a casing or outer skin having a first end and a second end, the first end including a portion to attach a compaction element and the second end including a portion to attach a drive adapter. The compaction element can be attached to the first end with a male or female connection. Within the mandrel can be a transversal rod guide originating at the first end, extending through the mandrel, and held in place by at least one transversal rod guide support. Casing can include an aggregate feed cavity and at least one aggregate port therein to allow delivery of aggregate out the sides of the mandrel. The mandrel can further include an elongated body portion located within the casing. In some embodiments, the casing can be removed from the mandrel.

A post tensioned foundation installation device or system can further include a tension rod assembly having a tensioning rod and a reaction plate. In other embodiments, the tension rod can be housed within the transversal rod guide and the bottom reaction plate can rest against the compaction element. In some embodiments, a reaction plate can be flat or conical, and threaded or not threaded. In some embodiments, the tensioning rod is threaded, and in others it is not.

In other embodiments, the compaction element can include at least one torque transfer element (e.g., a pin) and the reaction plate can have another torque transfer element (e.g., a pin recess) that weds with the other joining element. The opposite can also be true.

Also described herein are methods of installing post tensioned foundations comprising the steps: a. filling a feed cavity associated with the post tensioned foundation installation device that is driven and rotated to a depth with at least one type of aggregate; b. leaving a bottom reaction plate attached to a tensioning rod at the depth; c. moving the post tensioned foundation installation device upward to a predetermined height thereby creating a void and releasing the at least one type of aggregate into the void while rotating the post tensioned foundation installation device until a specified amount of aggregate is deposited around the perimeter of a mandrel or minimum torque requirements are exceeded; d. compacting the at least one type of aggregate within the void thereby creating compacted aggregate; and e. securing a top plate to the tensioning rod over the compacted aggregate.

In some embodiments, the post foundation installation device can be rotated without being axially driven. In other words, the post foundation installation device can be rotated in place.

In one embodiment, post tensioned foundation installation devices are described comprising: a mandrel with an elongated body having a first end and a second end, the first end including a compaction element and the second end including a power tool attachment section. The elongated body can include a transversal rod guide conduit originating at the compaction element and terminating at or before the power tool attachment point. Also, an outer skin or casing can surround at least a portion of the elongated body portion or can form the elongated body portion and can define an aggregate feed cavity, wherein the aggregate feed cavity comprises at least one opening at the compaction element. Also, one or more aggregate feed port can be located on or in outer skin or casing.

In other embodiments, the tension rod assembly can be housed within the transverse rod guide and the reaction plate can rest against the compaction element.

In some embodiments, the methods further comprise filling any remaining void with at least one type of soil and compacting said at least one type of soil before the placing step. In another embodiment, the securing step uses a nut threaded on the tensioning rod. In still another embodiment, steps c and d are preformed simultaneously. In other embodiments, the top reaction plate is formed of precast concrete, GFRP, plastic, recycled materials, nylon, metal, composites, polymers, or any strong, non-compressible, and semi-ductile composite material known in the art.

Also described herein are post tensioned foundations comprising a power driven and rotated reaction plate anchored to a tensioning rod buried within the earth; a column of compacted aggregate on top of the power driven reaction plate; compacted conditioned soil on top of the column of compacted aggregate; a top plate on top of the compacted conditioned soil; and an anchoring nut associated with the tensioning rod and on top of the top plate. The post foundation systems can further comprise a belled compacted aggregate segment at the bottom of the post foundation. Further still, the post foundation systems can further comprise at least one additional belled portion of compacted aggregate.

BRIEF DESCRIPTION OF THE DRAWINGS

FIG. 4A is a perspective view. FIG. 4D is a side view of the mandrel with the outer skin removed. FIG. 4E is a cross-section of the mandrel without the outer skin. FIG. 4O is a bottom view of an alternate bottom portion of the compaction element of FIG. 4H.

FIG. 5A is a perspective view. FIG. 5O is a bottom perspective view of a casing.

FIG. 6A is a partially exploded side view of the mandrel. FIG. 6B is a cross section of the mandrel in FIG. 6A. FIGS. 6C-H are cross-sectional and different direct views of the mandrel of FIG. 6A as outlined in FIG. 6B.

FIGS. 8A-M illustrate another exemplary temporary cased foundation installation method according to the present description using another mandrel device.

DETAILED DESCRIPTION

Figure 1A:
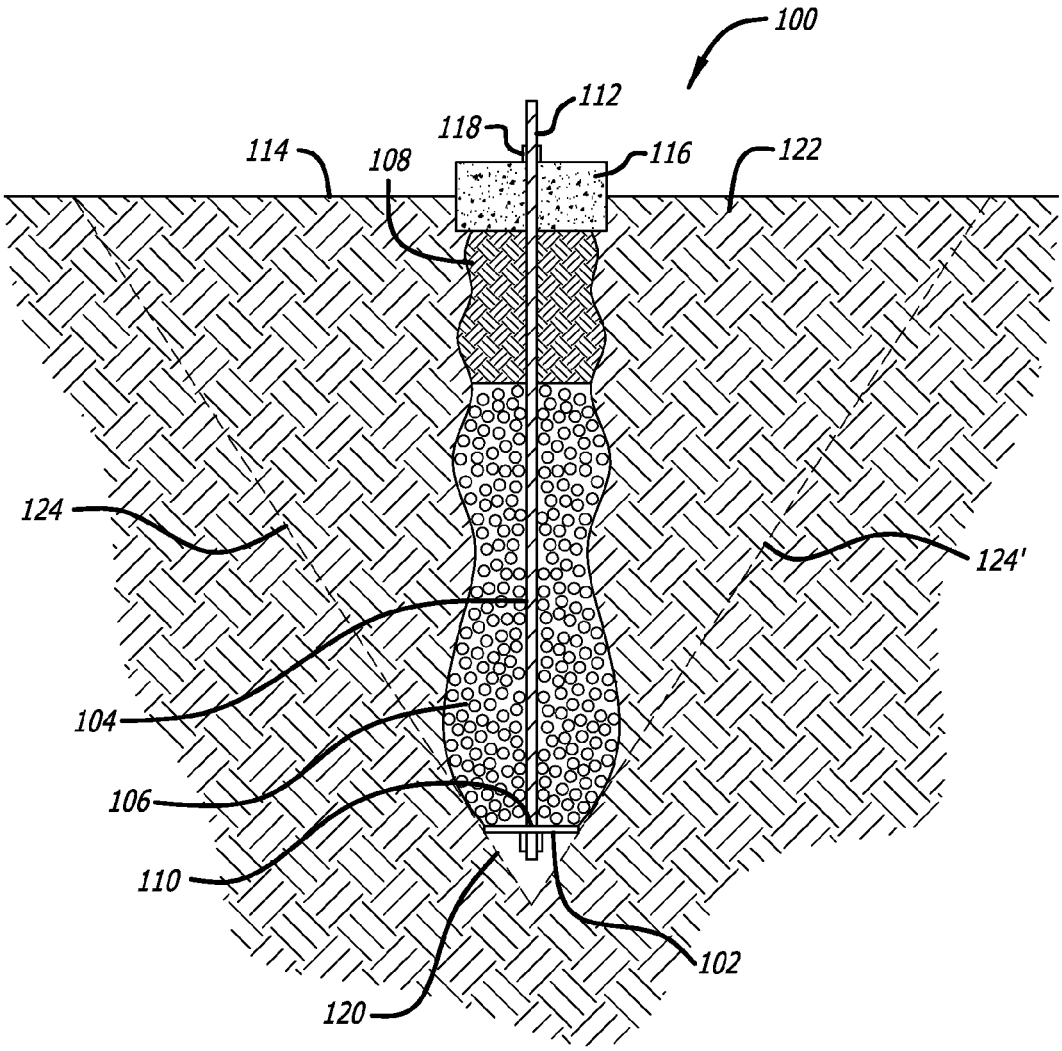
FIG. 1A illustrates a general post tensioned foundation according to the present description.

Described herein generally are post tensioned foundations which can support light weight structures in a variety of soil conditions. Apparatus and methods of installing the post tensioned foundation are also described.

The post tensioned foundations can be referred to as post tensioned shallow gravel columns (PTSGC) or light load ($L^2$) foundations and can be foundation systems generally designed to support light to medium weight structures. The foundations can consist of a reaction plate and rod assembly, at least one type of compacted aggregate, and a surface mounted tensioning and lateral resisting plate. When these elements are combined and pre-stressed, a monolithic foundation system is created able to resist pullout, compressive and lateral forces.

The foundations described herein can be used to support light to medium loads such as solar panels, solar panel support apparatus, street lights, playground equipment, telephone/electric poles, street signs, fence posts, flag poles, and the like.

The foundations can be installed using a tool called a mandrel that has been designed to drive and/or rotate the reaction plate and rod assembly into the ground, fill the void with aggregate during mandrel extraction, and then compact the newly placed aggregate column thereby expanding the aggregate into the surrounding soil. The mandrels described herein can be used with or without a separate sleeve or casing.

Most current shallow foundation designs use concrete footings or some other type of earth embedded high strength pier to anchor and support above ground structures. Under some conditions which include wind and seismic loading, the structural requirements of a foundation system must be engineered to resist compressive, tensile, and lateral loads. These multiple requirements place large structural demands on current foundation elements which in most cases are satisfied by the predominant use of concrete and steel in the design. These materials are characterized as: dense (having large mass to volume ratio), stiff (ability to resist high applied force with little deformation), strong (having an ability to withstand an applied stress without failure), costly to produce, transport, and usually require removal at the end of their lifecycle.

Foundation methods generally rely on the soil's bearing capacity and/or friction to obtain their resistive capacity, yet they must be designed to not exceed the soils strength or bearing capacity. This relationship/interaction between the structure's foundation (spread footing or pier) and the soil can lead to very costly foundation designs due to the fact that the foundation materials must scale up in size and strength to compensate for the soil's inability to resist loads. For example, weaker soils require larger and stronger foundation elements to "spread out" the loads over a larger soil bearing area. All of the above requirements result in generally expensive and sometimes cost prohibitive foundations.

In contrast, the post tensioned foundations of the present description can be simplified and structurally efficient designs that incorporate readily available, light, and inexpensive materials which can be assembled using installation processes, tooling, and equipment yielding significant benefits when compared to existing engineering and construction practice. Cost, schedule, and environmental advantages are the result of a combination of design technique, material selection, and installation equipment, tooling, and processes. The effective use of the foundation's structural elements combined with the installation method can result in superior soil-structure interaction producing a more efficient foundation system when compared to current foundation systems.

The presently described pier foundation can be effectively and efficiently installed in many different types of existing soils and does not require the in situ soil to be improved or excavated prior to the installation of the foundation systems. Thus, the present foundations, systems, methods and apparatus can provide a reduced price, increased construction speed, and/or environmental advantage compared to current foundation systems. The construction methods of the present foundations and systems simultaneously densify the surrounding soil, improving the structural capacity of the pier itself, at the same time that the pier construction is occurring. This concurrent combination of ground improvement and pier construction can yield high design and/or construction efficiencies. Finally, once a site is decommissioned, the foundation's design and construction materials facilitate site dismantling with virtually no impact to the environment, making it a sustainable technology.

Figure 1B:
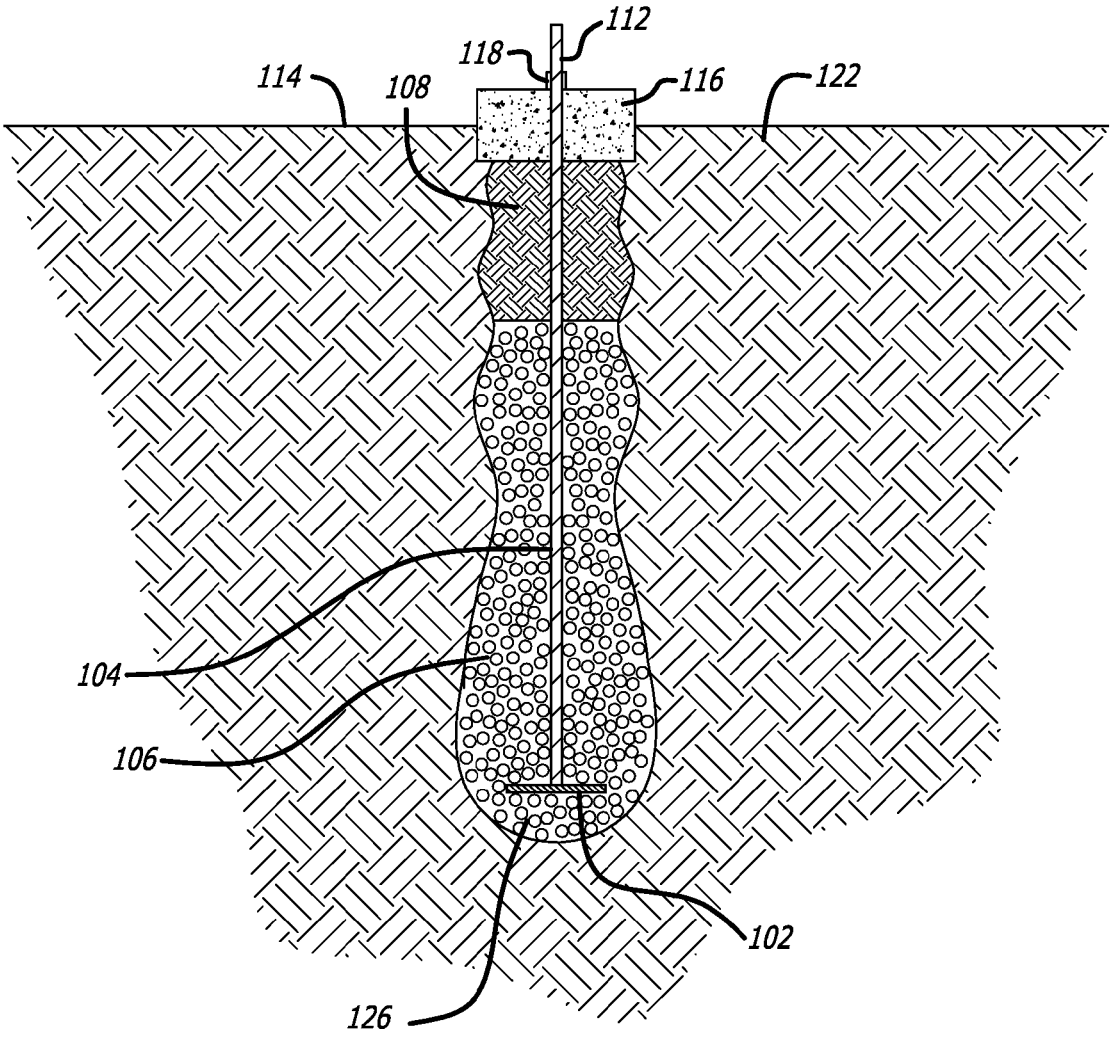
FIG. 1B illustrates another general post tensioned foundation according to the present description.

As illustrated in FIG. 1, post tensioned foundation system 100 generally includes a reaction plate 102 anchored to tensioning rod 104. Reaction plate 102 and tensioning rod 104 can be installed into the earth by driving, rotation or both. A column of aggregate 106 is compacted on top of reaction plate 102. Optionally, atop aggregate 106 is conditioned soil 108 compacted thereon. Tensioning rod 104 has first end 110 anchored to reaction plate 102 and second end 112 sticking out beyond ground level 114. Top plate 116 is rested on top of the column (now compacted) and anchoring device 118 is used to hold top plate 116 in place thereby preserving the tension within post tensioned foundation system 100. In some embodiments, the system does not include conditioned soil 108. Rather, column of aggregate 106 can extend from reaction plate 102 to top plate 116.

In other embodiments, the overall shape of the foundation may vary. For example, some foundations can have a bell shape at the bottom while others might not. Also, some may have bulges along the body or top and others might not.

In an alternate embodiment, top plate 116 is placed directly on top of aggregate 106. In some embodiments, as illustrated in FIG. 1, the top of conditioned soil 108 is below ground level 114. Yet in other embodiments, the top of conditioned soil 108 is at about ground level 114. Top plate 116 can be formed of any strong, non-compressible, and/or semi-ductile composite material. Example material used to form top plate 116 can be precast concrete, steel, GFRP, plastic, nylon, HDPE, recycled materials, or a combination thereof. The material used can be dependent on cost, strength, corrosion, weight, sustainability, and/or service life.

Reaction plate 102 can have a flat shape as illustrated. However, in some embodiments, a reaction plate can have a conical shape 120 or any other shape that can be used to achieve a foundation as described.

In one embodiment, the systems described herein can be designed to transfer tension, compression, and lateral loads from an above ground structure directly to the in situ soil. The pier is built with top and bottom reaction plates, a rod that connects the plates together, and at least one compacted aggregate in between the two plates that transfers loads to the soil. In order to bind the soil-gravel matrix together, compressive (normal) force created by pre-stressing the top and bottom plates sandwich the aggregate between the top and bottom reaction plates as they are cinched together using the tensioning rod and bolts. The above ground compressive loads are transferred from the above ground structural elements to the in situ soil through the rod, top reaction plate, and the gravel with some of the load transferring down the rod to the bottom reaction plate and compacted aggregate pier tip. Tensile loads are transferred through the rod which is connected to the bottom reaction plate. This entire assembly transfers its loads through aggregate 106 and then to the surrounding soil via skin friction. The tensile load can be resisted by the weight of the column, the weight of the soil in failure wedge 122 outlined by failure plane 124,124' as seen in FIG. 1, and/or soil shear strength (cohesion and interparticle friction).

The load capacity of the systems described herein can be dependent on the density and strength of the surrounding soil and the skin friction developed between the pier and the soil. Therefore, a combination of aggregate materials and in situ soil densification and compaction techniques improve the pier's surrounding soil load bearing capacity, expand the pier's base (belling), and simultaneously compact and densify the aggregate column increasing the pier's load capacity. These efficiencies are achieved using inexpensive structural and geotechnical materials. The systems can further be constructed, for example, using a "drifter" mounted on a 100 kW drill rig that provides both rotational and compactive forces to densify the soil, install and retract the mandrel, displace the gravel into the side wall and densify the aggregate.

In one example embodiment, the surface area of the reaction plate can vary from about 10 to about 150 square inches and be comprised of a square, round, or hexagonal shape. The bottom of the plate could be flat, rounded, or conically shaped. Reaction plates according to the present description can be made of steel, plastic, nylon, recycled materials, or any other strong and ductile composite material known in the art.

The reaction plate's ground engaging surface can be smooth or formed with a spiral configuration to facilitate insertion with rotational force. The reaction plate's inner aggregate facing surface can be smooth, or have specially designed torque transfer elements used to transfer the rotational force supplied from a mandrel to the reaction plate during installation. Torque transfer elements can include pins or other protrusions as well as voids or other features that can associate the pins, protrusion, or voids in the joining element.

The reaction plate and rod assembly can be made of corrosive or non-corrosive materials and could be joined by welding, screwing, adhesive, compression, or a combination of some or all of the above. The rod can be threaded or smooth, made of steel, glass fiber reinforced polymer (GFRP), or other high tensile strength materials.

Figure 2:
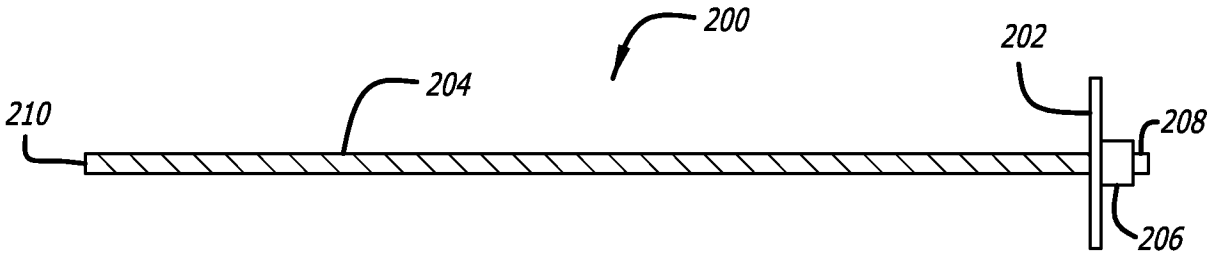
FIG. 2 illustrates an example rod and flat reaction plate assembly.

For example, in one embodiment, tension rod assembly 200 as illustrated in FIG. 2 includes both reaction plate 202 and tensioning rod 204. Reaction plate 202 is flat in shape and held in place by nut 206. In this embodiment, tensioning rod is threaded and as such, nut 206 is threaded into first end 208 of tensioning rod 204. A top plate (not illustrated) is placed through tensioning rod 204 and a nut (not illustrated) is threaded onto tensioning rod 204 near second end 210.

Figure 3B:
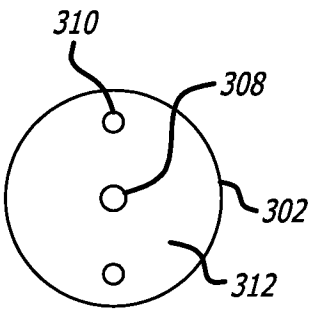
FIGS. 3A and 3B illustrate an example rod and conical reaction plate assembly.
Figure 3A:
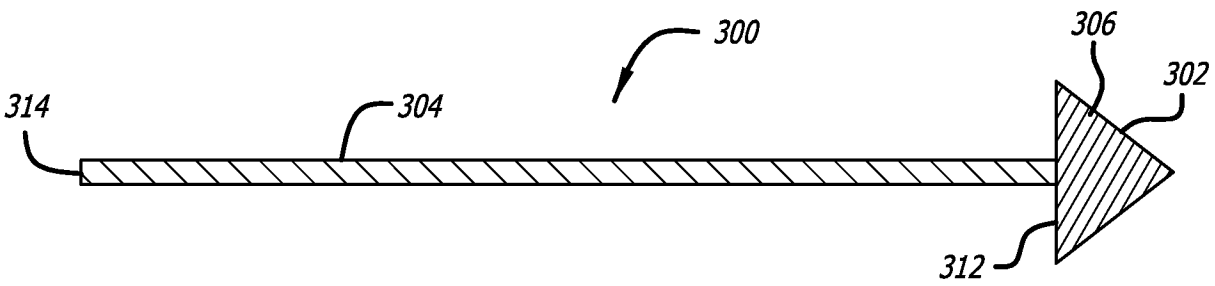

In an alternate embodiment, as illustrated in FIGS. 3A and 3B, tension rod assembly 300 includes both reaction plate 302 and tensioning rod 304. Here reaction plate 302 is conical in shape and includes threads 306 to aid in rotationally inserting the reaction plate and compacting the column perimeter soil. Tensioning rod assembly 300 can be rotated during installation in the direction of threads 306 or against the direction of threads 306. When rotated in the same direction as the threads, the threads help pull the mandrel into the ground. When rotated in the opposite direction of the threads, the threads displace soil away from the cone permitting the crowd force to advance the tooling. Tensioning rod 304 can be threaded and reaction plate 302 can simply screw onto tensioning rod 304 through a threaded mounting hole 308. Reaction plate 302 can have one or more first type of torque transfer element 310 on its flat face 312 to accommodate a second type of torque transfer element from a mandrel. Like tension rod assembly 200, tensioning rod 304 accommodates a top plate (not illustrated) at end 314 placed through tensioning rod 304 and a nut (not illustrated) is threaded onto tensioning rod 304 to hold top plate in place near second end 314.

At least one type of aggregate, soil and/or sand can be used in the post tensioned foundations described herein. Aggregate can be natural or recycled and can include a binder material consisting of concrete, asphalt, polymer, or combination of one or all. Both size and shape of an aggregate can play a role in a particular foundation design. In one embodiment, the aggregate can have an average diameter of about 1/16 in, 1/8 in, about 1/4 in, about 3/8 in, about 1/2 in, about 5/8 in, about 3/4 in, about 7/8 in, about 1 in, between about 1/16 in and about 1 inch, between about 1/2 in and about 1 in, between about 1/16 in and about 1/2 in, or between about 1/8 in and about 3/4 in. In a preferred embodiment, the diameter is about 3/8 inch. In another embodiment, the aggregate can be pea shaped or in other words smooth or can have a rugged surface. An exemplary rugged surface aggregate is crushed gravel. Soil and/or sand can include finely ground material having an average diameter of about 1/16 mm, 1/8 mm, about 1/4 mm, about 3/8 mm, about 1/2 mm, about 5/8 mm, about 3/4 mm, about 7/8 mm, about 1 mm, about 1.5 mm, about 2 mm, between about 1/16 mm and about 2 mm, between about 1/2 mm and about 1 mm, between about 1/16 mm and about 1/2 mm, or between about 1/8 mm and about 3/4 mm.

The top plate, also referred to as the top tensioning and lateral load resisting plate, can have various physical characteristics depending on a foundation design. A plate's surface area can vary from about 10 square inches to about 300 square inches. The plate can have a square or round shape and can have a flat, rounded, or conical cross section. The plate can be made of precast concrete, but can also be made of steel, GFRP, plastic, nylon, recycled materials, or any strong, non-compressible, and semi-ductile composite material known in the art.

The tensioning and lateral load resisting plate can have a smooth surface or rough surface with a high coefficient of friction facing the soil in order to maximize lateral load transfer to the soil and foundation thru soil interaction. The top plate can be made of corrosive or non-corrosive materials and could be joined to the tensioning rod by welding, bolting, screwing, adhesive, compression, or a combination of some or all of the above. In one preferred embodiment, the top plate is held to the tensioning rod using a nut threaded onto the tensioning rod.

Figures 4A, 4C:
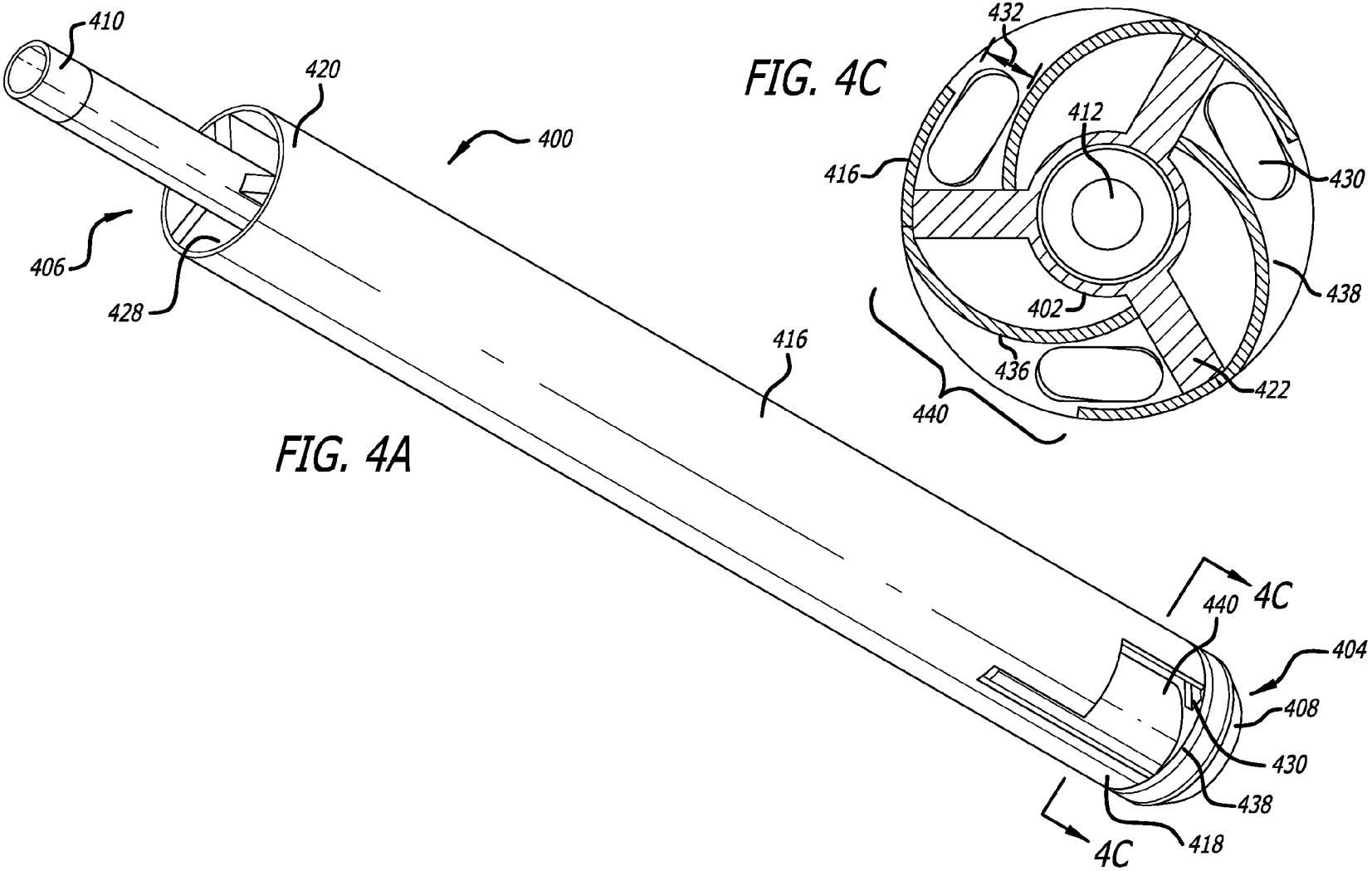
FIGS. 4A-O illustrate an example mandrel.
FIG. 4C is a cross-section.
Figure 4B:
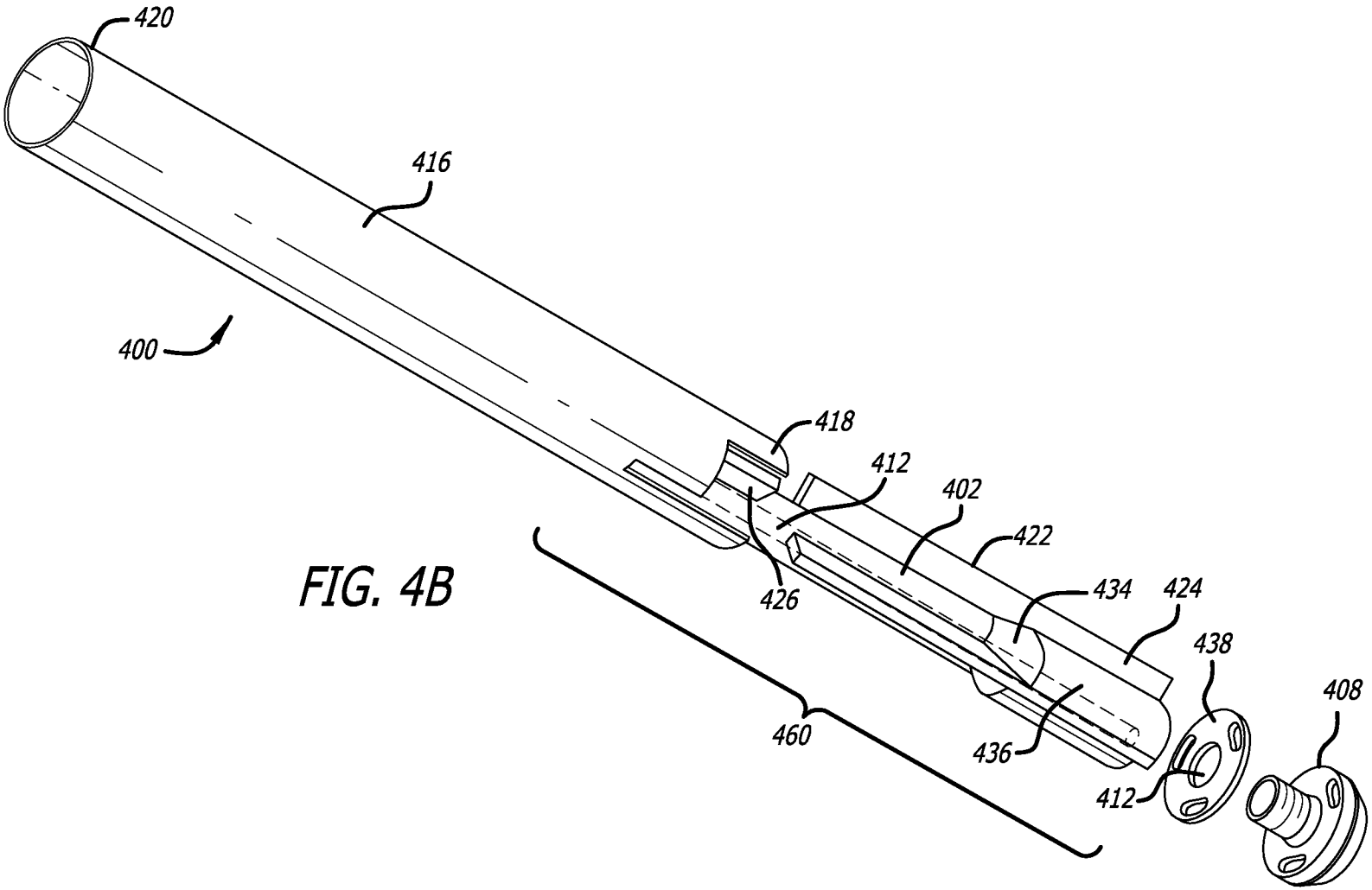
FIG. 4B is a perspective view with a portion of outer skin removed.
Figure 4F:
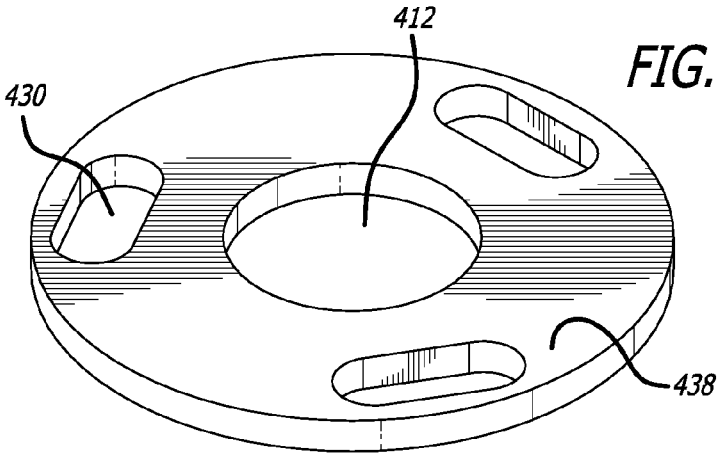
FIG. 4F illustrates an example force transfer apparatus.
Figure 4G:
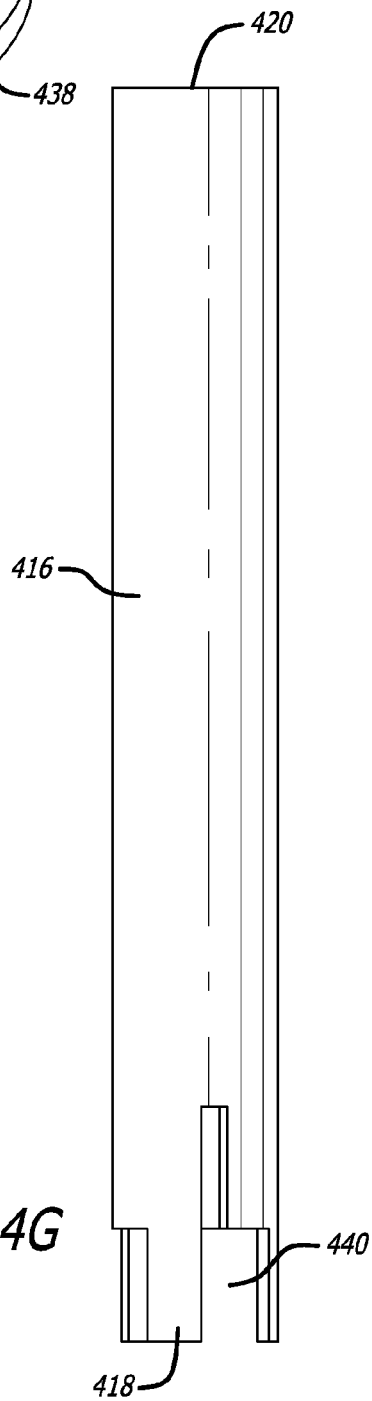
FIG. 4G illustrates an outer skin.
Figure 4H:
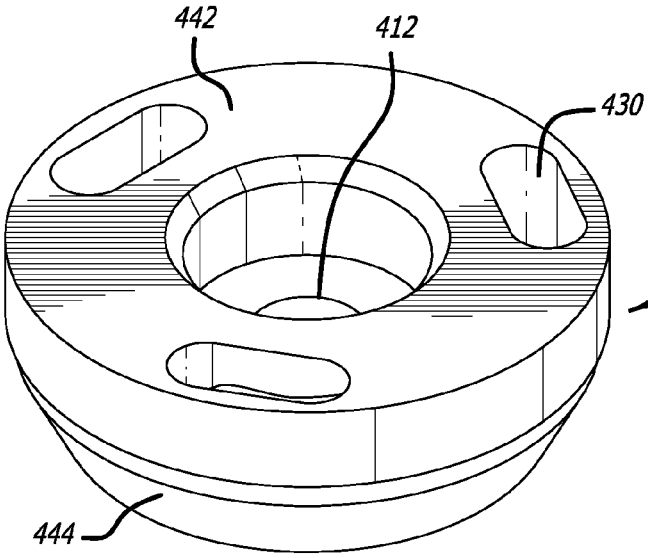
FIG. 4H illustrates a perspective view of a compaction element.
Figure 4I:
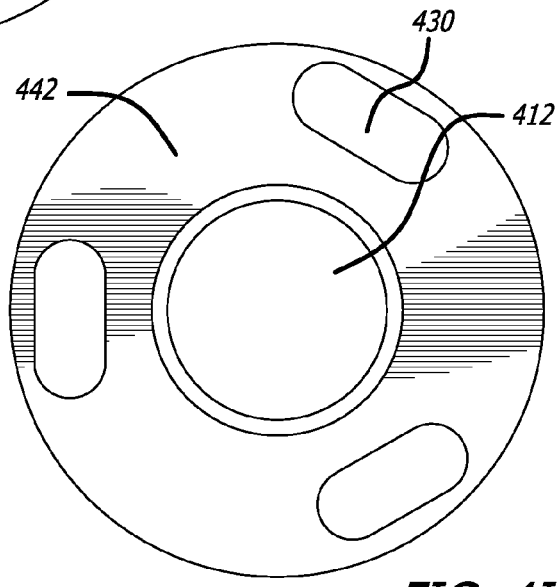
FIG. 4I is a top view of the top portion of the compaction element of FIG. 4H.
Figure 4J:
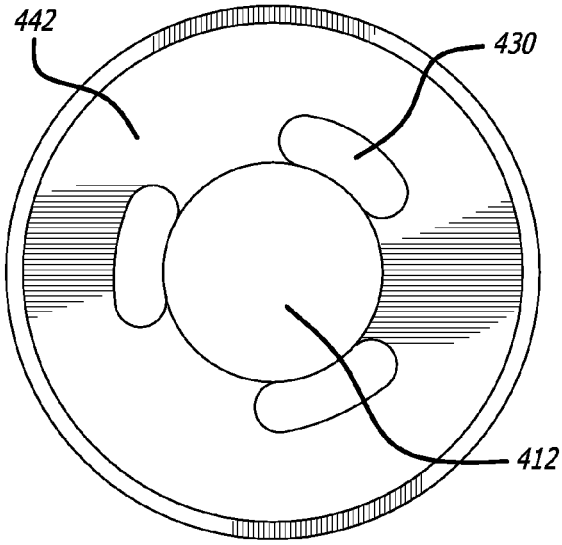
FIG. 4J is a bottom view of the top portion of the compaction element of FIG. 4H.
Figure 4K:
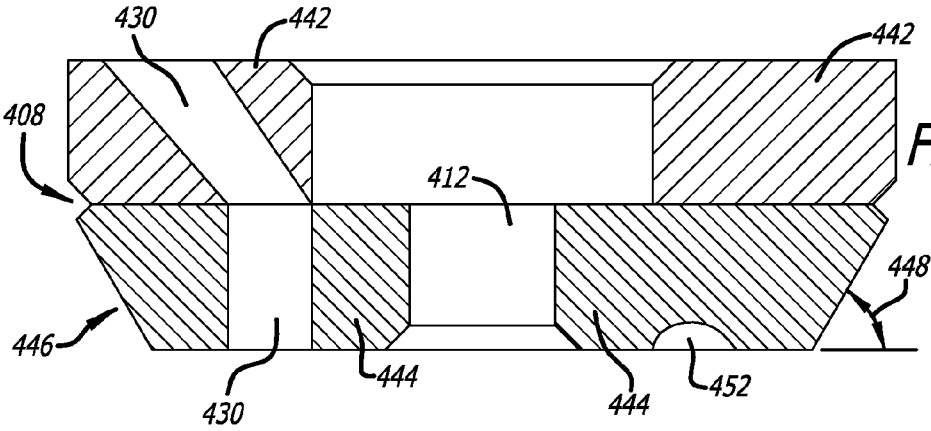
FIG. 4K is a cross-section of the compaction element of FIG. 4H.
Figure 4L:
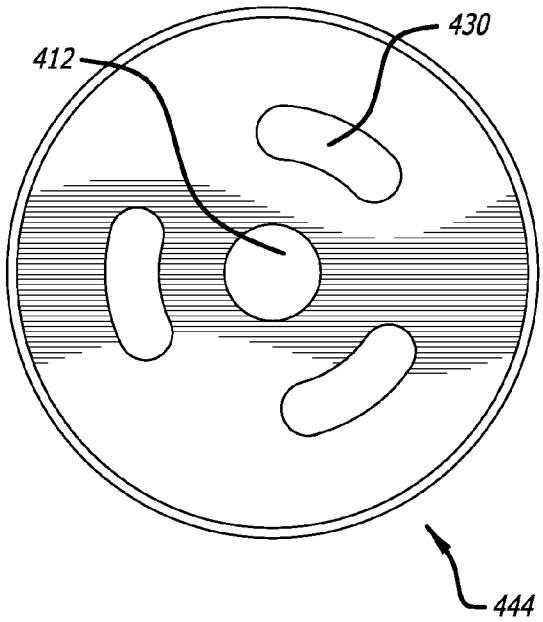
FIG. 4L is a top view of the bottom portion of the compaction element of FIG. 4H.
Figure 4M:
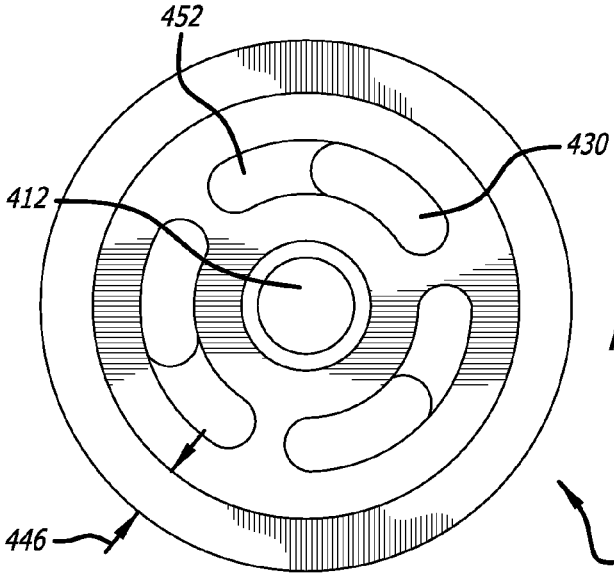
FIG. 4M is a bottom view of the bottom portion of the compaction element of FIG. 4H.
Figure 4N:
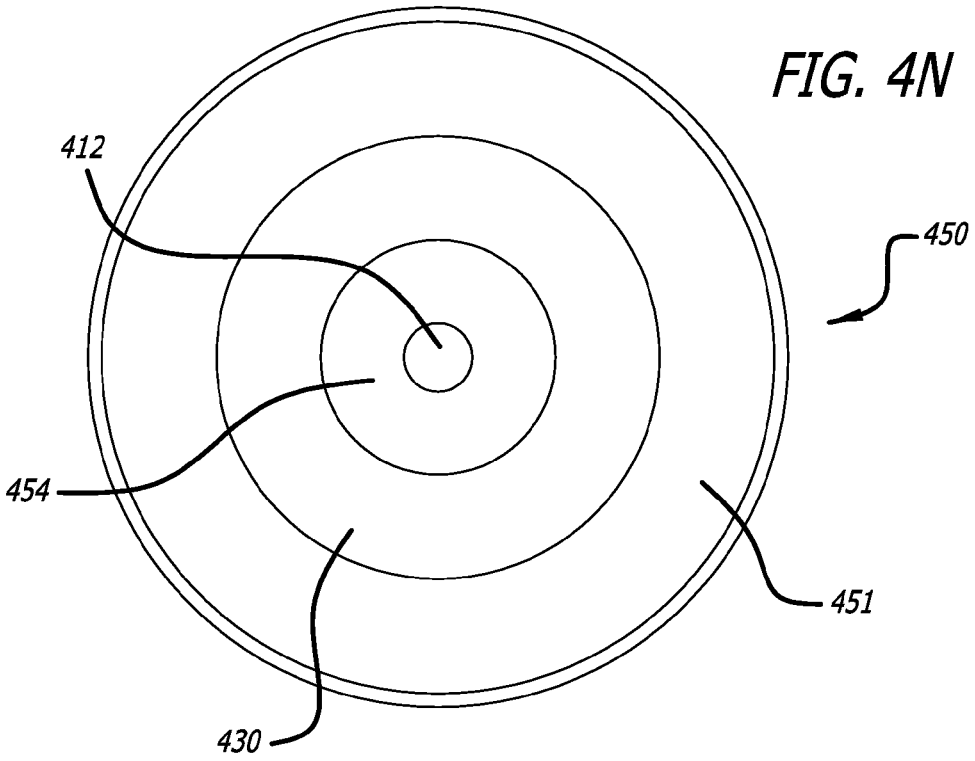
FIG. 4N is a top view of an alternate bottom portion of the compaction element of FIG. 4H.
Figure 4O:
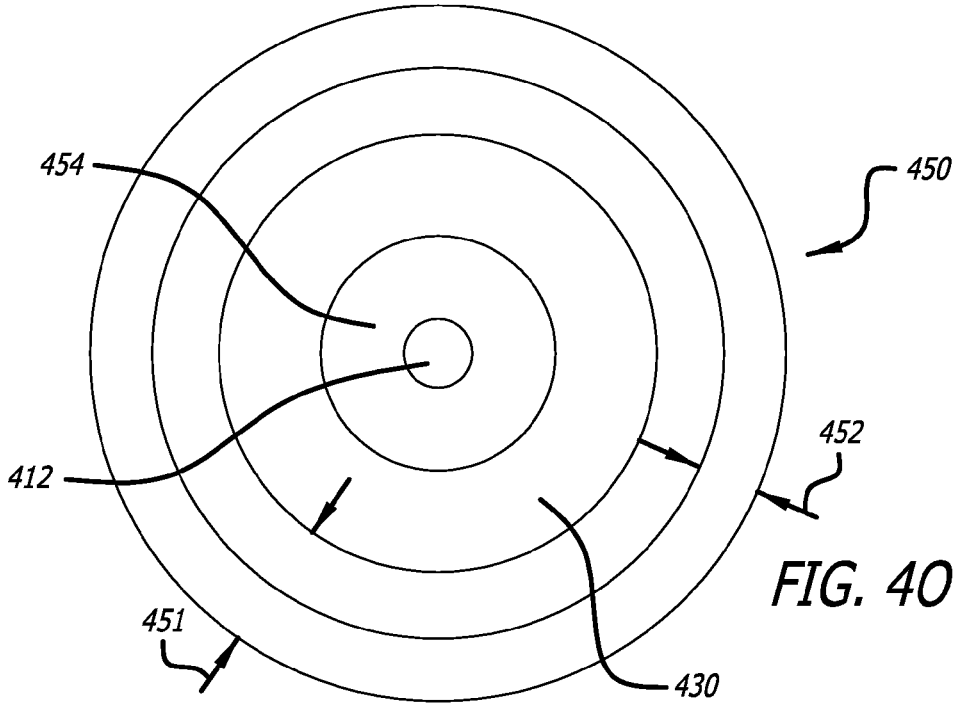

A tool used to drive the reaction plate, compact/densify in situ soil, deliver the aggregate, compact the aggregate and optionally compact conditioned soil is a mandrel. An exemplary mandrel 400 is illustrated in FIGS. 4A-O. Mandrel 400 includes an elongated body portion 402 having first end 404 and second end 406. First end 404 includes a force transfer surface 438 and second end 406 includes a power tool attachment section 410 which can be male or female. Compaction element 408 is attached to first end 404 with a male or female connection and rests against force transfer surface 438. Within elongated body portion is transversal rod guide 412 originating at compaction surface 408 and extending through the elongated body 402. Elongated body portion 402 can include a striking sledge portion 460. Mandrel 400 further includes an outer skin 416 attached to elongated body portion 402 and surrounding at least a portion of elongated body portion 402. In one embodiment, outer skin 416 circumferentially surrounds all of elongated body portion 402 and can extend from first end 418 adjacent to compaction element 408 to second end 420 near power tool attachment section 410 as illustrated. In some embodiments, first end 418 of outer skin 416 can aid in compaction. In other embodiments, first end 418 of outer skin 416 may not aid in compaction.

Outer skin 416 can be attached to elongated body portion 402 using at least one stiffener spacer 422. In some embodiments, two or more stiffener spacers are located in tiers. For example, mandrel 400 includes first tier 424 and second tier 426. Each tier can have two or more stiffener spacers, preferably four. In other embodiments, tiers can be spaced to evenly distribute a load. For example, one tier can include three stiffener spacers and a second tier positioned 120 degrees offset the first tier and half way down the first tier can contain three stiffener spacers.

An aggregate feed cavity 428 is defined between elongated body portion 402 and outer skin 416 wherein feed cavity 428 comprises at least one opening 430 at compaction element 408. The size 432 of the at least one opening is dependent on the size, surface consistency and the like of the aggregate used. Further, size 432 can be adjusted, for example, to accommodate different sized or shaped aggregate as needed for a particular soil type by attaching a different compaction element 408 that has the appropriate seized opening 430 for the aggregate size used to construct the pier.

To use a mandrel to drive a reaction plate into the earth, a tension rod assembly including a reaction plate attached to a tensioning rod is inserted into transversal rod guide 412. When the tensioning rod assembly is fully inserted into the transversal rod guide 412, the reaction plate can rest against compaction element 408. Further, as discussed above, compaction element 408 can include one or more torque pins or recesses for torque pins on the reaction plate.

First end 418 includes at least one gravel or aggregate port 440. In some embodiments, first end 418 includes three aggregate ports. Elongated body portion 402 fits within outer skin 416 and includes aggregate feed cavity 428, cricket 434, curved compaction element 436, force transfer surface 438, and compaction element 408.

As torque is applied to the mandrel, a normal force can be generated at curved compaction element 436 that displaces aggregate into the side wall of a column. The torque can increase as the rotationally induced inter-particle friction creates additional aggregate drag and increasing column wall soil densification as the aggregate column diameter expands into the surrounding soil. Then, once pre-stated minimum torque thresholds are exceeded, the casing and mandrel are incrementally withdrawn to continue a belling process at the next elevation. As the tool is raised, aggregate can fill the created void below via aggregate port 430 which can then be compacted using drill equipment's crowd and hammer forces. Such a process will be explained in greater detail below.

Compaction Element 408 is comprised of first compaction foot 442 and second compaction foot 444. First compaction foot 442 can have the aggregate chute 430 sloped in where it is closer to the outside at the top of first compaction foot 442 and closer to the inside (or rod guide conduit) at the bottom. Other embodiments can have an aggregate chute 430 that goes straight through the first compaction foot 442. Second compaction foot 444 can have a tapered outside perimeter 446 with angle 448 from the horizontal to increase the soil compaction against the side wall of the column. The aggregate chute 430, at the bottom of the second compaction foot 444, can be tapered 452 away from the direction of rotation in order to push the aggregate out without crushing it. Other embodiments can be used for the second compaction foot depending on the soil and aggregate type. For example, the second compaction foot 450 can be comprised of an outer first ring 451 that can have a flat or tapered outer perimeter 452. A smaller diameter void 430 is then formed by an interior circular "washer" element 454 formed inside the middle of the first ring 451 creating a continuous round chute 430 for dispensing aggregate.

In each embodiment, above, first compaction feet and second compaction feet can be formed as a single piece or a separate pieces that can be welded together or joined during assembly. In one embodiment, a first compaction foot and a second compaction foot can be shaped out of a single piece of metal (e.g., steel) by an appropriate tool (e.g., milling tool).

Figure 5A:
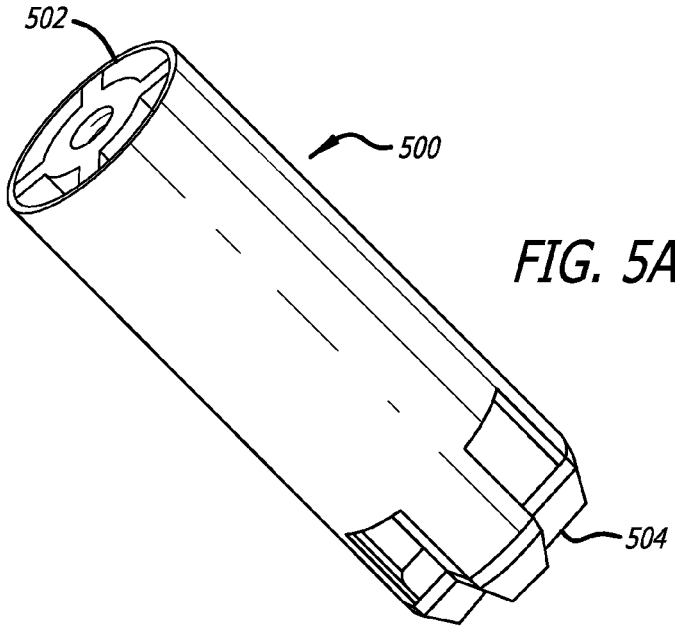
FIGS. 5A-O illustrate an example mandrel.
Figure 5B:
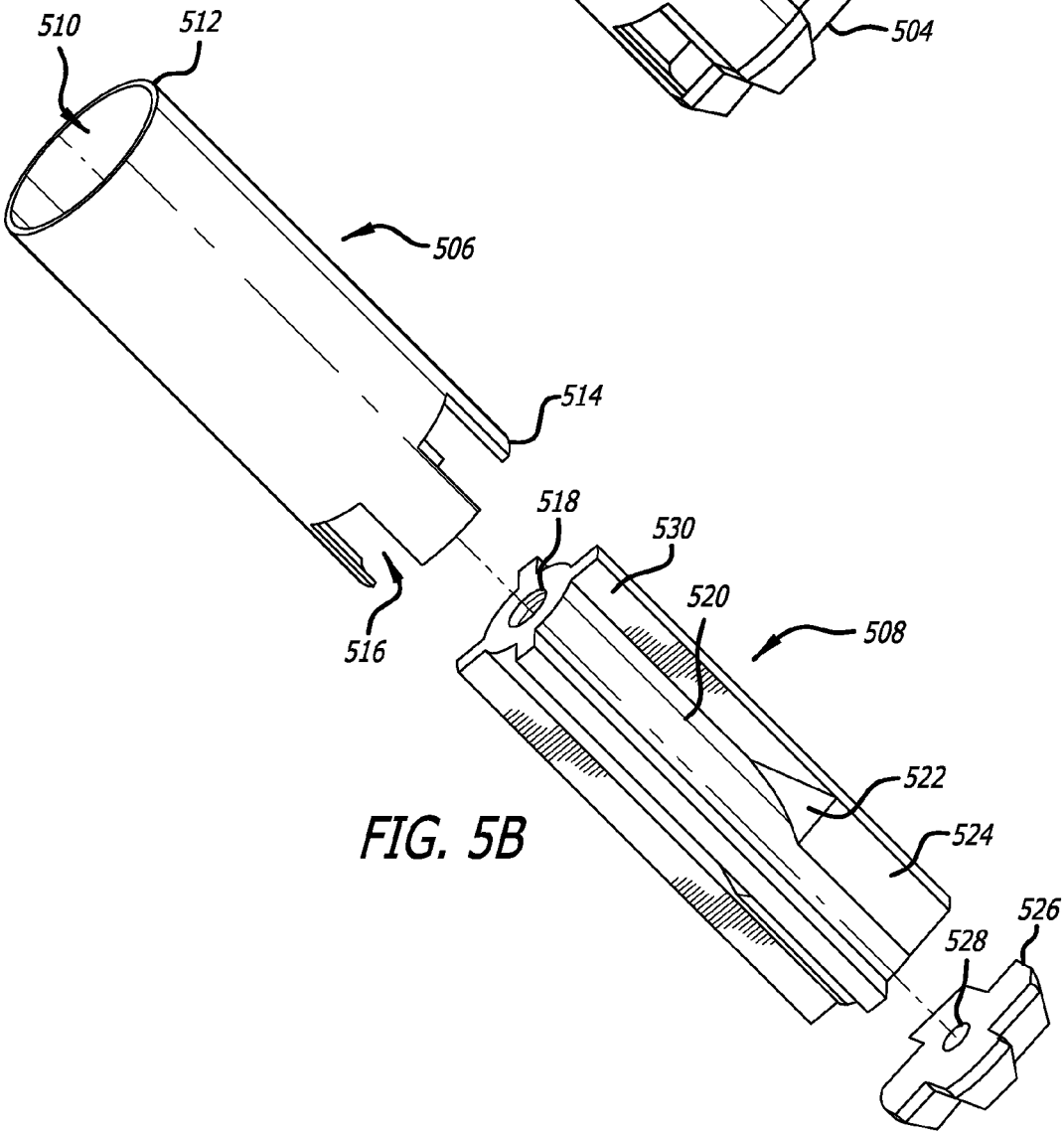
FIG. 5B is an exploded perspective view.
Figure 5C:
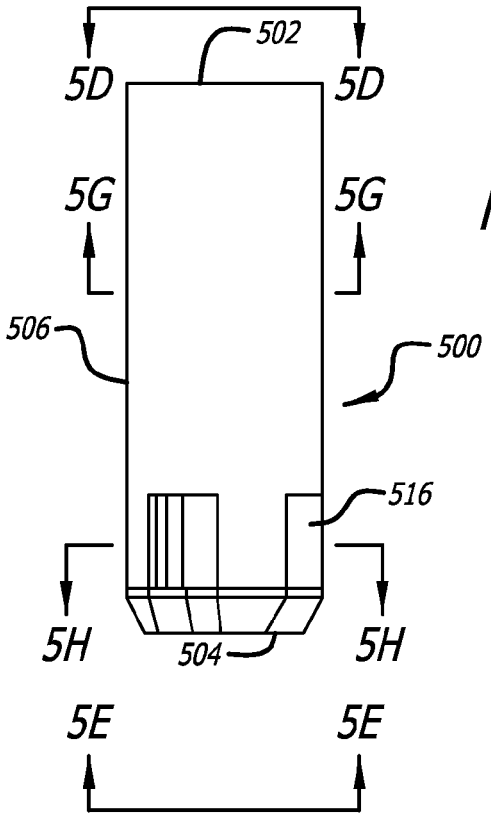
FIG. 5C is a side view.
Figure 5D:
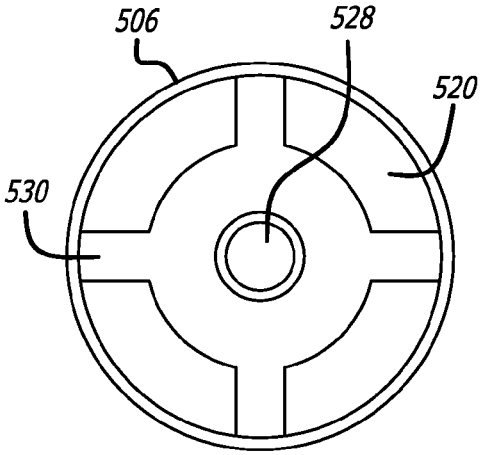
FIG. 5D is a top view and 5E is a bottom view.
Figure 5E:
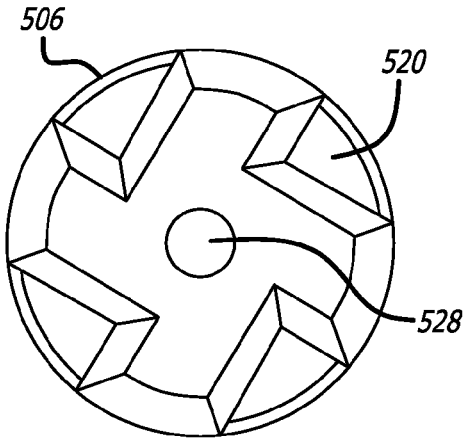
FIGS. 5F-N illustrate various cross-sectional views.
Figure 5F:
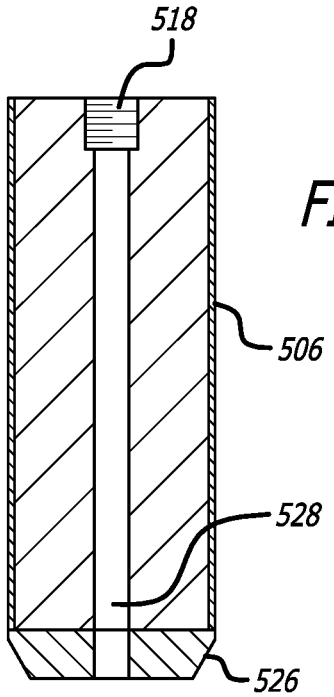
Figure 5G:
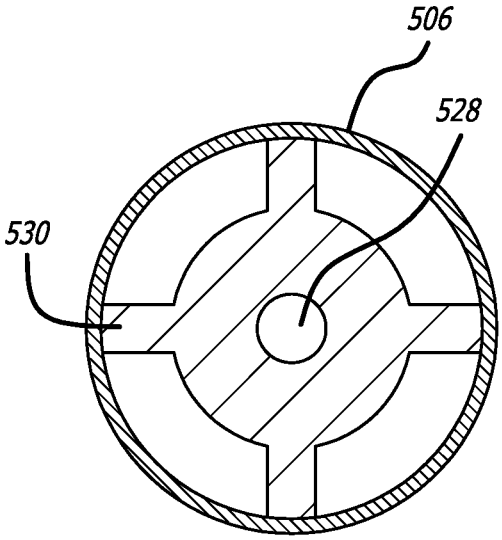
Figure 5H:
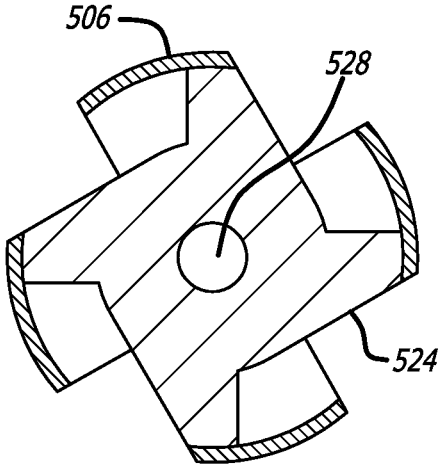
Figure 5I:
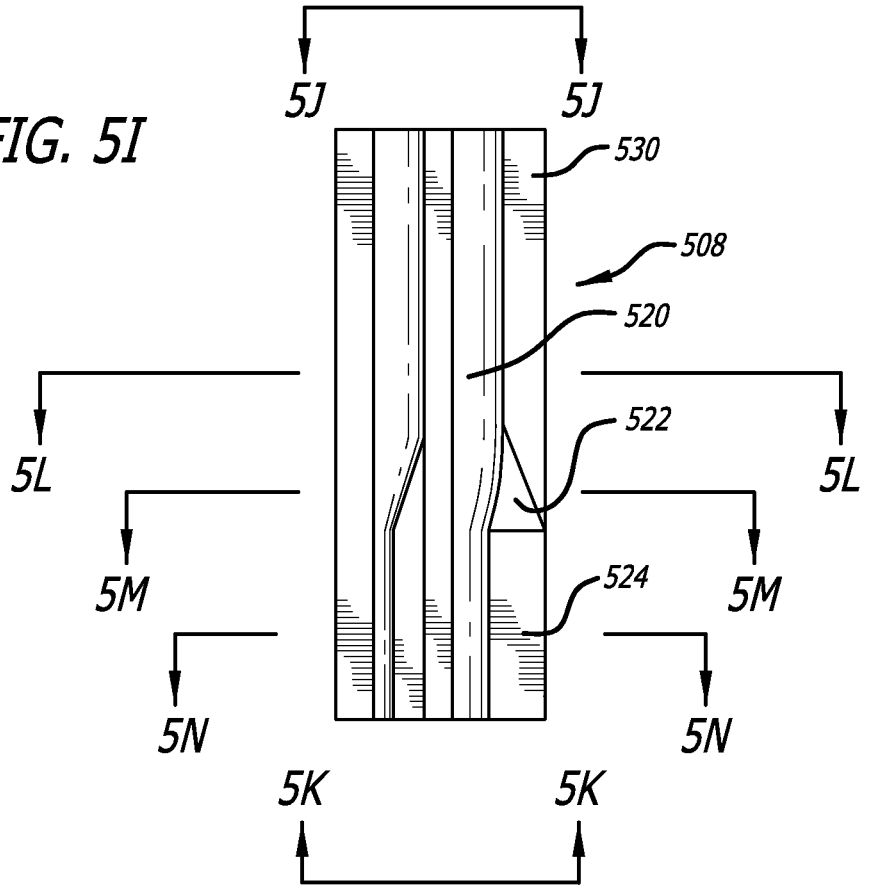
Figure 5J:
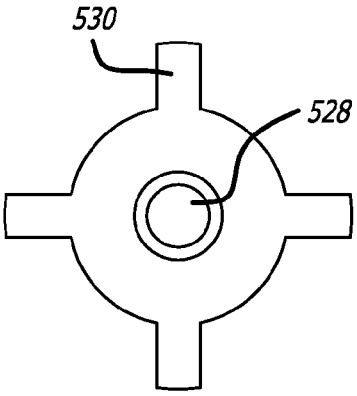
Figure 5K:
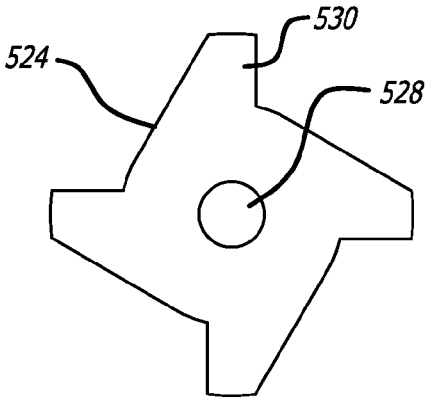
Figure 5L:
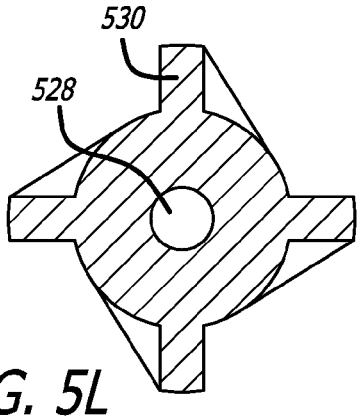
Figure 5M:
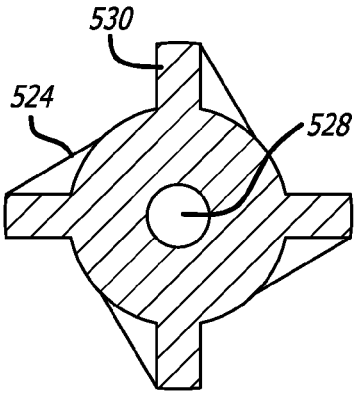
Figure 5N:
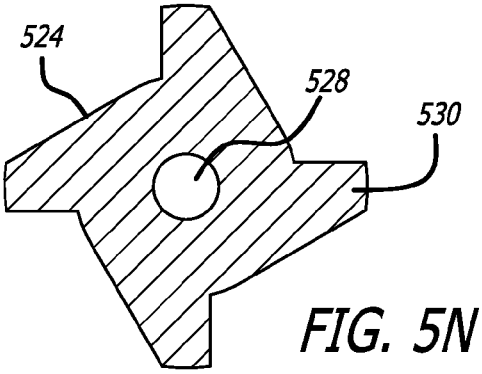
Figure 50:
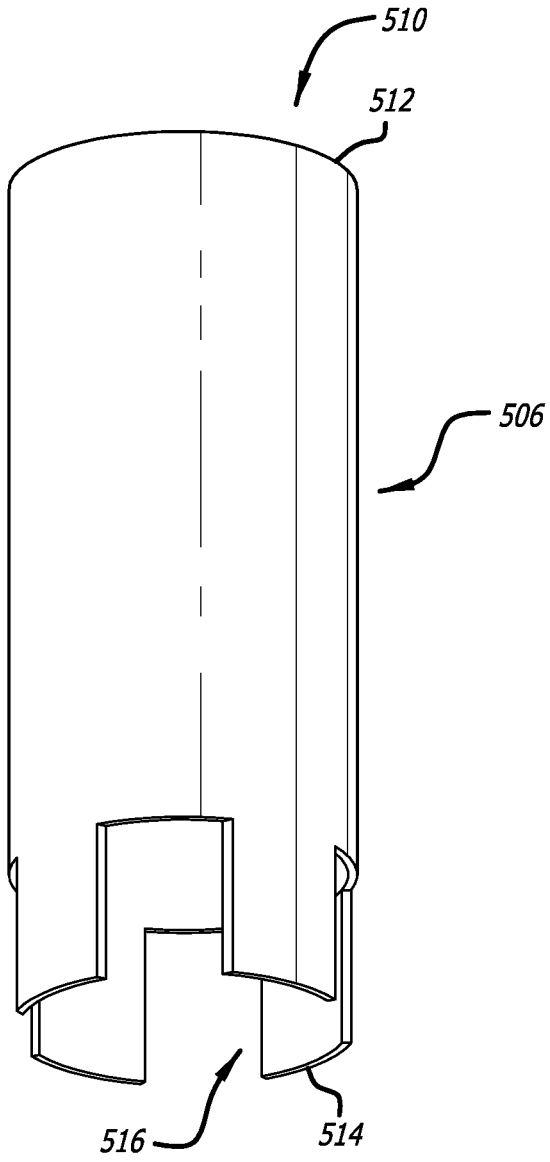

Another installation system 500 is illustrated in FIGS. 5A-O. System 500 includes top surface 502 and bottom face 504. Compaction generally occurs at and adjacent to bottom face 504. Mandrel casing 506, as illustrated in FIG. 5O, surrounds striking sledge 508. Casing 506 includes a generally cylindrical shape with a hollow interior 510, a first side 512 and a second side 514. Casing can have a thickness of about ⅛ inch, ¼ inch, ½ inch ¾ inch, or 1 inch.

Casing 506 can be attached to striking sledge 508 using at least one stiffener spacer 530. In some embodiments, two or more stiffener spacers are located in tiers. In other embodiments, tiers can be spaced to evenly distribute a load. For example, one upper tier can include three or four evenly spaced stiffener spacers and a second tier offsetting the first tier and positioned below the first tier can contain three or four stiffener spacers. Second side 514 includes at least one gravel or aggregate port 516. In some embodiments, second side 514 includes three or four aggregate ports. Striking sledge fits within hollow interior 510 and includes stem coupling 518 (which can be male or female), aggregate chute 520, cricket 522, triangular compaction element 524, and axial compaction element 526 which can be attached with a male or female connection (not illustrated) including tension rod conduit 528.

As torque is applied to the mandrel, a normal force can be generated at the compaction element 524 that displaces aggregate into the side wall of a column. The torque can increase as the rotationally induced inter-particle friction creates additional aggregate drag and increasing column wall soil densification as the aggregate column diameter expands into the surrounding soil. Then, the casing and mandrel are incrementally withdrawn to continue pier wall densification at the next elevation. As the tool is raised, aggregate can fill the created void below via aggregate chute 520 which can then be compacted using drill equipment's crowd and hammer forces.

Another exemplary mandrel 600 is illustrated in FIGS. 6A-H. Mandrel 600 includes a casing 614 having a first end 602 and second end 604. First end 602 can include a portion to attach compaction element 606 and second end 604 can include a portion to attach drive adapter 616. Drive adapter 616 can include power tool attachment section 608 which can be male or female. Compaction element 606 is attached to first end 602 with a male or female connection and can rest against it. Within mandrel 600 is transversal rod guide 610 originating at first end 602, extending through the mandrel 600, and held in place by at least one transversal rod guide support 612. Mandrel 600 further includes an outer skin or casing 614. In one embodiment, casing 614 circumferentially surrounds all of transversal rod guide 610 and can extend from first end 602 adjacent to compaction element 606 to second end 604 near power tool attachment section 608 as illustrated. In some embodiments, first end 602 can aid in compaction by transferring force from drive adapter 616 located at second end 604 to compaction element 606.

Casing 614 as described can be attached to transversal rod guide 610 using at least one transversal rod guide support 612. In some embodiments, two or more transversal rod guide supports are located in tiers.

An annulus aggregate cavity 618 is defined between transversal rod guide 610 and casing 614 wherein annulus aggregate cavity 618 includes at least one port 620 at compaction element 606. The size of the at least one port is dependent on the size, surface consistency and the like of the aggregate used. Further, the size can be adjusted, for example, to accommodate different sized or shaped aggregate as needed for a particular soil type by attaching a different compaction element 606 that has the appropriate seized port 620 for the aggregate size used to construct the pier.

To use mandrel 600 to drive a reaction plate into the earth, a tension rod assembly including conical reaction plate 622 with threaded mounting hole 308 permits screwed attachment to tensioning rod 304 which is then inserted into transversal rod guide 610. When the tensioning rod assembly is fully inserted into the transversal rod guide 610, the interior 628 of conical reaction plate 622 can rest against the exterior 632 of compaction element 606. The driving or axial force of the mandrel 600 can be transferred from the compaction element 606 face 636 to the conical reaction plate 622 drive surface 627. Further, conical reaction plate 622 can include one or more wings 624 formed from cuts 630 in the plate. The wings 624 can allow the upper diameter 626 to expand as aggregate and compaction element 606 are driven into interior 628 of conical reaction plate 622 thereby deforming the wings. Deformed wings can provide increased resisting force preventing tensile extraction of tensioning rod assembly 200 or 300 once installed.

Compaction Element 606 can have aggregate port 620 on sloped face 632. Also, compaction element 606 can have port 634 on face 636 to allow tensioning rod 304 traverse it. Compaction element 606 can further be threaded onto casing 614. Compaction element 606 can have any shape that allows aggregate compaction and aggregate feed there through.

Further, in order to retain aggregate within annulus aggregate cavity 618 until release is needed through aggregate port 620, conical reaction plate 622 can include one or more torque transfer elements 638 that can match the opening shape of aggregate port 620. Torque transfer elements 638 can prevent premature aggregate release when conical reaction plate 622 is fitted against compaction element 606.

Mandrel 600 can further include at least one interior compaction element. An interior compaction element can be attached to transversal rod guide 610 and casing 614. The interior compaction elements 642 and/or 644 can assist in compacting aggregate against the side wall of a column as aggregate is pushed out during mandrel rotation of at least one side aggregate port 640 in casing 614. Also, interior compaction elements can prevent aggregate from traveling back up annulus aggregate cavity 618 during compaction. Interior compaction elements can be curved to further aid in torque induced lateral aggregate compaction and prevention of aggregate reverse flow back up into the mandrel during axial compaction. Such a curve can also be downward in a spiral configuration. In one embodiment, mandrel 600 includes one, two, three, four, five, six, seven, eight, nine, ten, eleven, twelve, or more interior compaction elements which may or may not be curved. Each interior compaction element can be matched up with a side aggregate port 640 and/or be at a different elevation within the mandrel. As such, casing can include one, two, three, four, five, six, seven, eight, nine, ten, eleven, twelve, or more aggregate ports in it. In another embodiment, mandrel includes at least first curved compaction element 642 and second curved compaction element 644.

As torque is applied to the mandrel, a normal force can be generated at curved compaction elements that displace aggregate into the side wall of a column. The torque can increase as the rotationally induced inter-particle friction creates additional aggregate drag and increasing column wall soil densification as the aggregate column diameter expands into the surrounding soil. Then, once pre-stated minimum torque thresholds are exceeded, the mandrel can be incrementally withdrawn to continue the process at a next elevation. As the tool is raised, aggregate can fill the created void below via aggregate port 620 which can then be compacted using drill equipment's crowd and hammer forces.

Aggregate can be fed into annulus aggregate cavity 618 through aggregate fill port 646 in casing 614. Aggregate fill port 646 can be located anywhere on mandrel 600 that allows proper foundation installation while still allowing the cavity to be filled with aggregate. In one embodiment, aggregate fill port 646 can be located near second end of mandrel 600. In another embodiment, aggregate fill port 646 can be located in drive adapter 616.

Further described herein are methods of installing post tensioned foundations and foundation systems. The methods generally can be more cost effective, less labor intensive, faster, and/or provide a better end product when anchoring light to medium weight structures using the present foundations and foundation systems.

The first step in constructing a post tensioned foundation system as described can be to attach a mandrel as described herein to a hydraulic hammer arm of a heavy construction vehicle. The mandrel is positioned such that the power tool attachment section engages the hydraulic hammer. The mandrel is secured to the hammer using appropriate fixing methods known in the art. In other embodiments, the mandrel can be equipped with a connection/disconnection contraption such as a socketed male/female threaded connection that attaches (e.g., quickly and/or easily) and detaches from the hammer for interchanging of different sized mandrels for different post tensioned foundation load needs or differing soil types on a construction site.

Figure 7A:
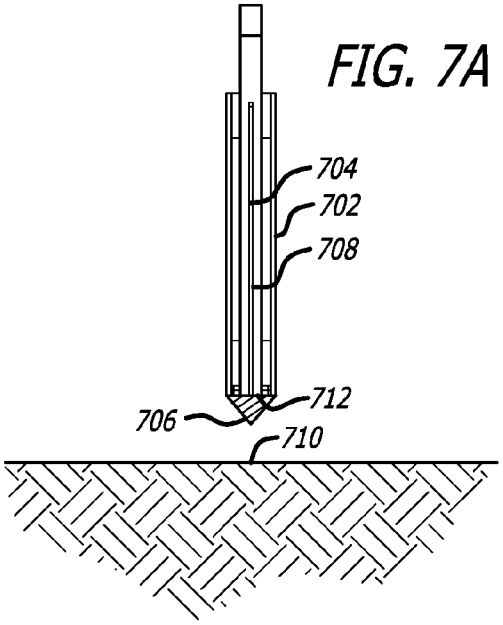
FIGS. 7A-I illustrate an exemplary foundation installation method according to the present description.

A first example method of installing a foundation according to the present description using a mandrel as described herein is illustrated in FIGS. 7A-I. Referring to FIG. 7A, mandrel 702 is fitted with a tensioning rod assembly including a tension rod 704 and reaction plate 706 as described herein. Mandrel 702 can include a solid or ridged coupling device for temporarily mating with a hydraulically powered drill head assembly commonly referred to as a drifter, capable of providing both rotational 718 and compressive 736 forces to the tooling. The tension rod and reaction plate assembly is loaded into the transverse rod guide 708 within the mandrel 702. For this example, tension rod 704 is threaded and the reaction plate 706 is conical in shape with threads. Reaction plate 706 further includes two torque transfer elements that wed with torque transfer elements in the compaction element of the mandrel.

Next, a location 710 in the earth where the post tensioned foundation is to be installed is chosen. Generally, engineers and architects have plotted strategic locations for the foundation, but if they have not, locations can be chosen on site and appropriate mandrel sizes can be used based on the soil conditions. Once location 710 has been determined for a post tensioned foundation, reaction plate 706 on top of mandrel's compaction surface 712 is engaged with location 710 and the hammer is activated thereby pounding reaction plate 706 into the earth. Mandrel 702 is attached to a hammer arm of an appropriate machine.

Figure 7B:
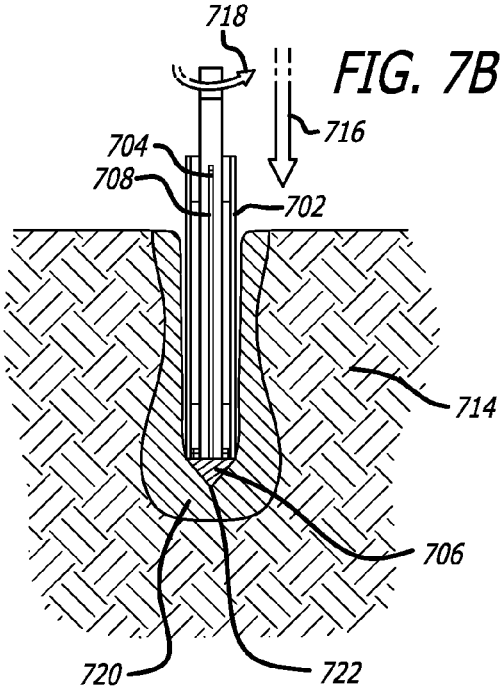

Referring now to FIG. 7B, as mandrel 702 and hence reaction plate 706 is driven farther into in situ soil 714, downward force 716 is used and can also be accompanied with rotational force 718. However, rotational force 718 may not be needed in all cases. Further, as the apparatus is driven further into in situ soil 714, compacted soil 720 is created around the apparatus. This compacted soil aids in improving the soil and aggregate column's stressed state within the completed post tensioned foundation. When a desired depth 722 is reached, the hammer is deactivated.

Figure 7C:
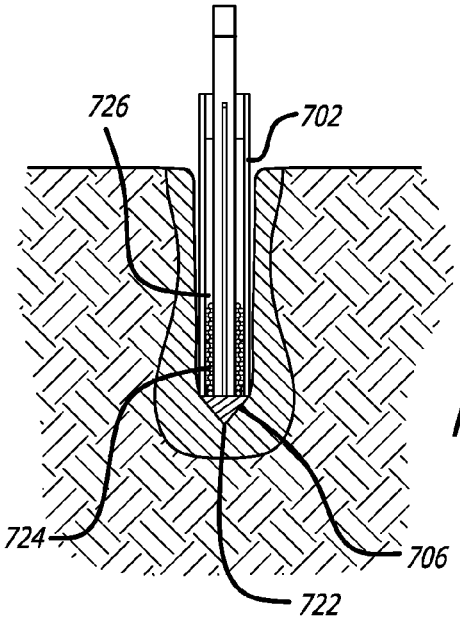

Next, as illustrated in FIG. 7C, at least one type of aggregate 724 is fed into aggregate feed cavity 726 defined within mandrel 702. The amount of aggregate 724 fed into aggregate feed cavity 726 can be a predetermined amount consistent with the void created by lifting the mandrel in the next step. The predetermined amount of aggregate is calculated based on the volume of void by lifting the mandrel a predetermined distance.

The tensioning rod assembly is then released from mandrel 702. In other embodiments, aggregate 724 can be loaded into the aggregate feed cavity 726 before the tensioning rod assembly is installed in the ground.

Figure 7D:
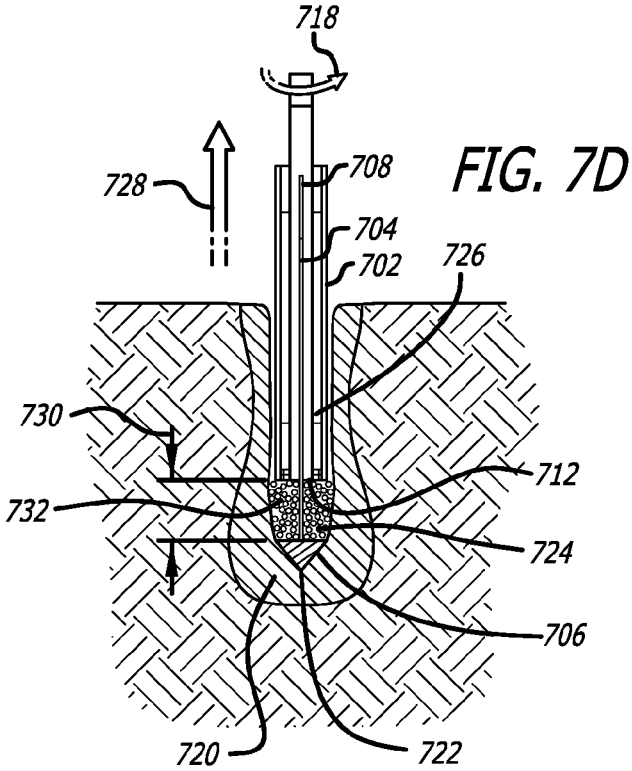

Mandrel 702 can then be lifted 728 a predetermined distance 730 as illustrated in FIG. 7D. As mandrel 702 is lifted, aggregate 724 from aggregate feed cavity 726 is dispensed through the annulus at compaction surface 712 as gravity pulls it down into void 732, thereby filling it with aggregate 724. The weight of the reaction plate and rod assembly and the weight of aggregate 724 and friction from compacted soil 720 can hold reaction plate 706 at desired depth 722. Predetermined distance 730 may be dependent on such factors as available compaction force, soil type, aggregate size, aggregate shape, depth and/or volume of void, and the like.

Figure 7E:
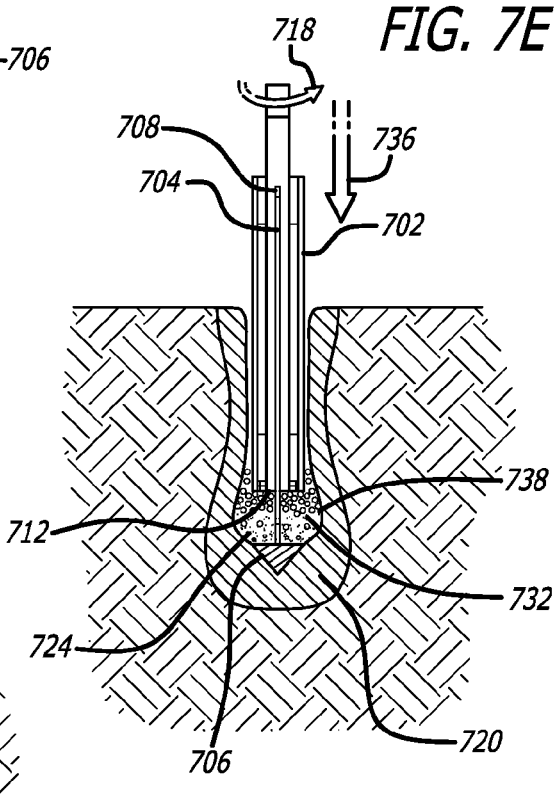

Then, as illustrated in FIG. 7E, in addition to rotation, the hammer is re-activated and aggregate 724 is compacted within void 732 using downward force 736 thereby compacting the aggregate and enhancing creation of the gravel bulb 738 whose normal force is resisted by compacted soil 720. The re-activation of the hammer can be deployed for a predetermined amount of time dependent on such factors as soil type, applied hammer force, compaction surface 712 size and geometry, aggregate size, aggregate shape, depth and/or volume of void, and the like.

Figure 7F:
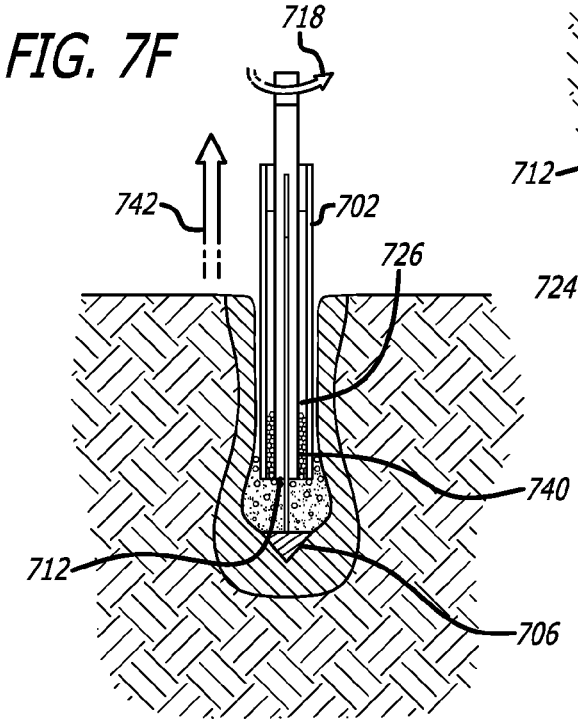
Figure 7G:
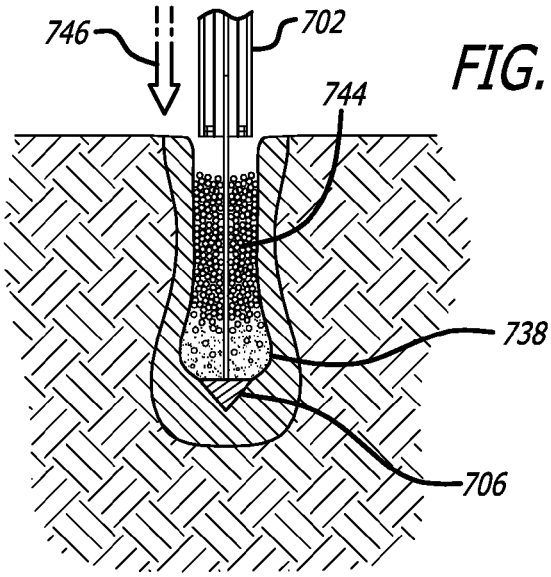

In FIGS. 7F and 7G, the steps illustrated in FIGS. 7C, 7D and 7E are repeated. In FIG. 7F, second load of aggregate 740 is loaded into aggregate feed cavity 726. Then, mandrel 702 is raised, again, a predetermined distance. As mandrel 702 is raised 742, second load of aggregate 740 from aggregate feed cavity 726 is dispensed through the aggregate ports at compaction surface 712 as gravity pulls it down into void 744 illustrated in FIG. 7G, thereby filling it with second load of aggregate 740 on top of the already compacted aggregate 738 below.

Once second load of aggregate 740 has been fed into void 744, again, the hammer is re-activated and second load of aggregate 740 is compacted within void 744 using downward force 746 thereby compacting second load of aggregate 740 on top of gravel bulb 738. The steps illustrated in FIGS. 7F and 7G can be repeated as necessary to reach a desired height 748 of compacted aggregate illustrated in FIG. 7H.

Figure 7H:
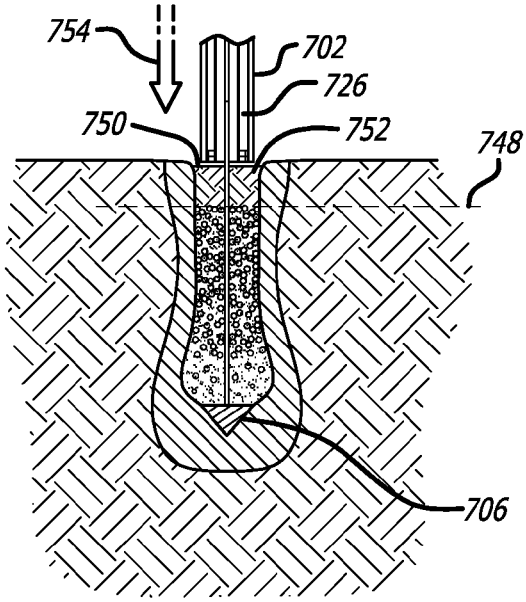

As an optional next step illustrated in FIG. 7H, conditioned soil 750 can be poured either directly into remaining void 752 or can be fed through aggregate feed cavity 726. This conditioned soil 750 can then be compacted using mandrel 702, the hammer and downward force 754.

Mandrel 702 can be a mandrel as described in FIG. 4A-O, FIG. 5A-O, or 6A-H.

Figure 7I:
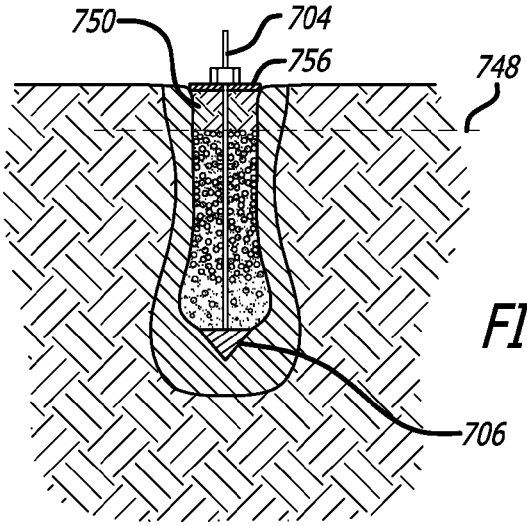

Referring to FIGS. 7H and 7I, top plate 756 can be placed either on top of compacted, conditioned soil 750 or directly on top of the compacted aggregate if the conditioned soil step is optionally skipped. Top plate 756 can have a hole in its center to accommodate tension rod 704 which may still extend out of the post tensioned foundation. Then, because tension rod 704 is threaded, a nut (or securing device if tension rod 704 is not threaded) is used to hold top plate 756 in place atop the post tensioned foundation. By bolting top plate 756 in place, the increased soil and aggregate stressed state of the post tensioned foundation can be preserved.

Figure 8A:
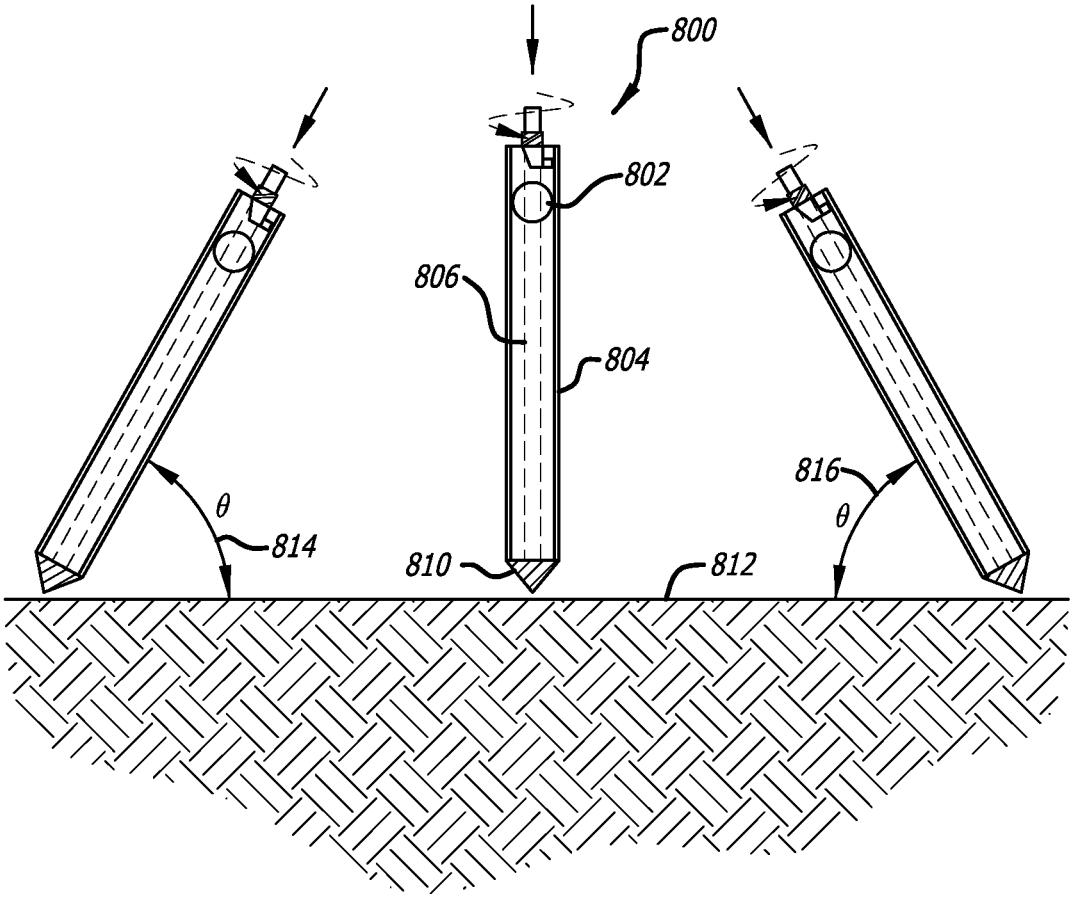

Another example system to install a foundation according to the present description is illustrated in FIGS. 8A-M. The tools used can be attached to common machinery. First, a location can be chosen as described above. Tool 800 includes port 802, casing 804, stem 806, displacement tool 810 and a mandrel 834. As illustrated in FIG. 8A, tool 800, can be used perpendicular to soil 812 or at varying angles 814 or 816. In some embodiments, each system described herein can be used or installed at different angles to accommodate terrain variations, load characteristics, above ground structure requirements and the like. For example, angles of about 5°, 10°, 15°, 20°, 30°, 40°, 50°, 60°, 70° or more can be utilized.

A conical shaped driving and displacement insertion tool can simultaneously displace, drive and screw the temporary casing into the ground displacing the soil to the outside of the pier resulting in densified soil and increasing the soil stress.

Once a desired depth is achieved, the driving and displacement insertion tool can be removed and the mandrel, bottom reaction plate and rod assembly are inserted into the casing. Then, the complete pier's supply of aggregate may be placed into the outer casing thereby charging the mandrel with aggregate.

The compaction process begins as the mandrel is hammered down into the aggregate previously placed at the toe of the pier compacting the pier's base and advancing the mandrel's side ports beyond the bottom of the stationary outer casing. Rotation of the mandrel is then commenced, initiating the pier sidewall compaction method accomplished through inter-particle friction created at the interface of the rotating aggregate with the stationary soil. This friction causes larger aggregate rock particles to decelerate. The advancing/rotating triangular compaction element then can force the aggregate out through the mandrel's horizontal ports into the yielding soil-grinding the aggregate into the pier's sidewall, expanding (or belling) the bottom of the pier. Once the pier's sidewalls are expanded and densified with the aggregate-soil composite, the mandrel and casing can be incrementally raised permitting some of the stored aggregate to fall out of the mandrel's force transfer foot bottom openings, filling the void left by the mandrel's retreat. The freshly placed aggregate is then engaged with the mandrel's force transfer foot and vectored compaction including both horizontal (lateral) and vertical (axial) aggregate compaction is achieved by application of axial compactive hammer force.

The method can rely on a torque induced normal force that pushes the gravel out of the discharge ports located on the side of the rotating mandrel as the particles engage with the soil surrounding the tool. As the aggregate layer builds up around the perimeter of the discharge ports, friction increases creating addition torque requirements on the system. Once specified torque requirements are achieved, the tool is raised permitting aggregate to exit through the base of the tool filling the void created by tool extraction. The tool is then reengaged with the aggregate (axial force) and compacted using the compaction mode. Axial force is created by a hydraulically driven hammering action (reciprocating piston) of a drifter.

The geotechnical stress state of the soil can be developed during column construction as the aggregate is compacted into the surrounding soil during simultaneous rotationally induced lateral compaction and vectored lateral and axial compaction created during the phased raising-filling-compaction process accomplished by the combination of a drifter and mandrel acting on the soil and aggregate matrix.

In addition to a particularly shaped mandrel foot used to apply both normal and lateral compactive forces, the system can rely on rotationally induced torque and inter-particle friction created by the surrounding soil and aggregate interface to force the aggregate laterally into the pier sidewalls thereby expanding the pier's diameter at the base. This increase in pier diameter at the base of the aggregate column increases the size of the failure wedge increasing the capacity of the pier in tension.

Further to the above explanation, as a first step in using tool 800 to install a pier as illustrated in FIG. 8B, temporary casing 804 is driven into soil 812 at a predetermined angle (e.g., angle 814) using displacement tool 810. Here, the angle can be 90° or perpendicular to soil 812. Using the applied forces described above, the entire temporary casing 804 and tool 800 can be rotated 818 as the tool is advanced into the soil. As advanced, displacement tool 810 can create improved soil 820 or densified soil. As described above, tool 800 can be advanced and optionally rotated using an impact hammer attached to thread 822.

Once desired depth 824 has been reached as illustrated in FIG. 8C, stem 806 and displacement tool 810 are removed from casing 804. Once stem 806 and displacement tool 810 are removed, as illustrated in FIG. 8D, void 826 is created where the tip portion of displacement tool 810 previously resided.

Figure 6A:
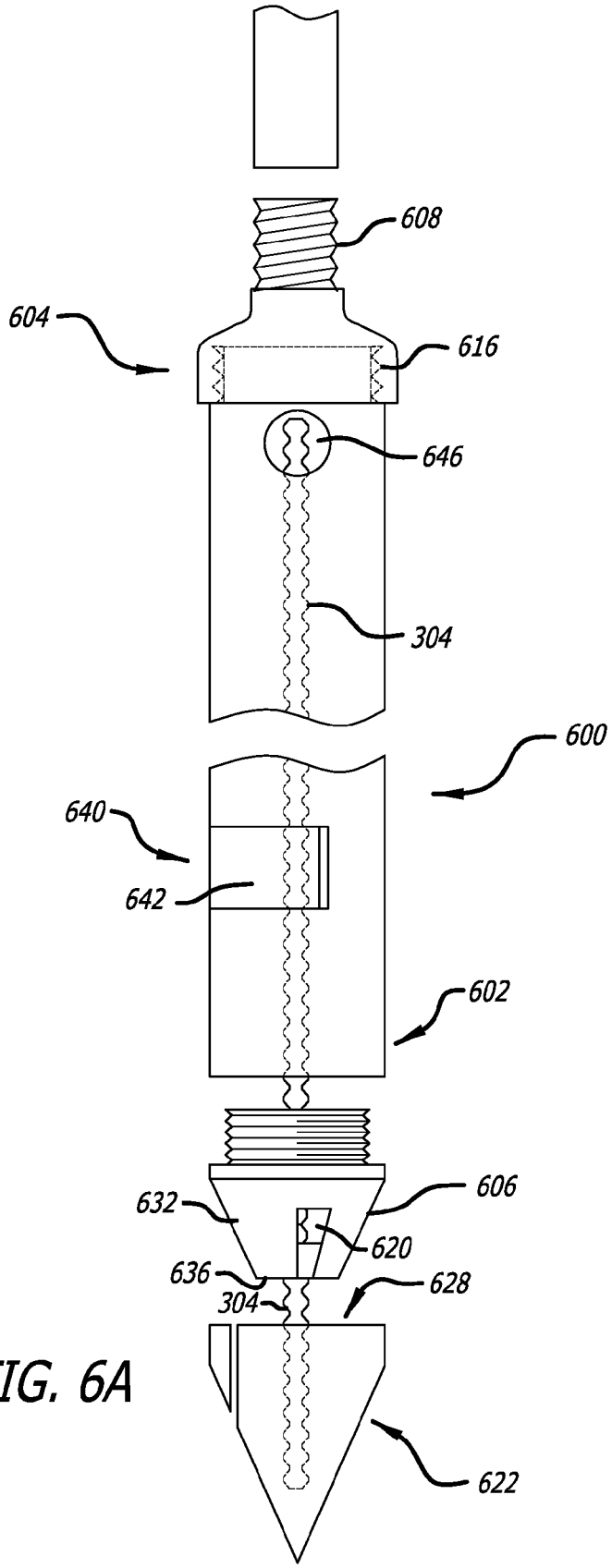
FIGS. 6A-H illustrate another exemplary mandrel.
Figure 6B:
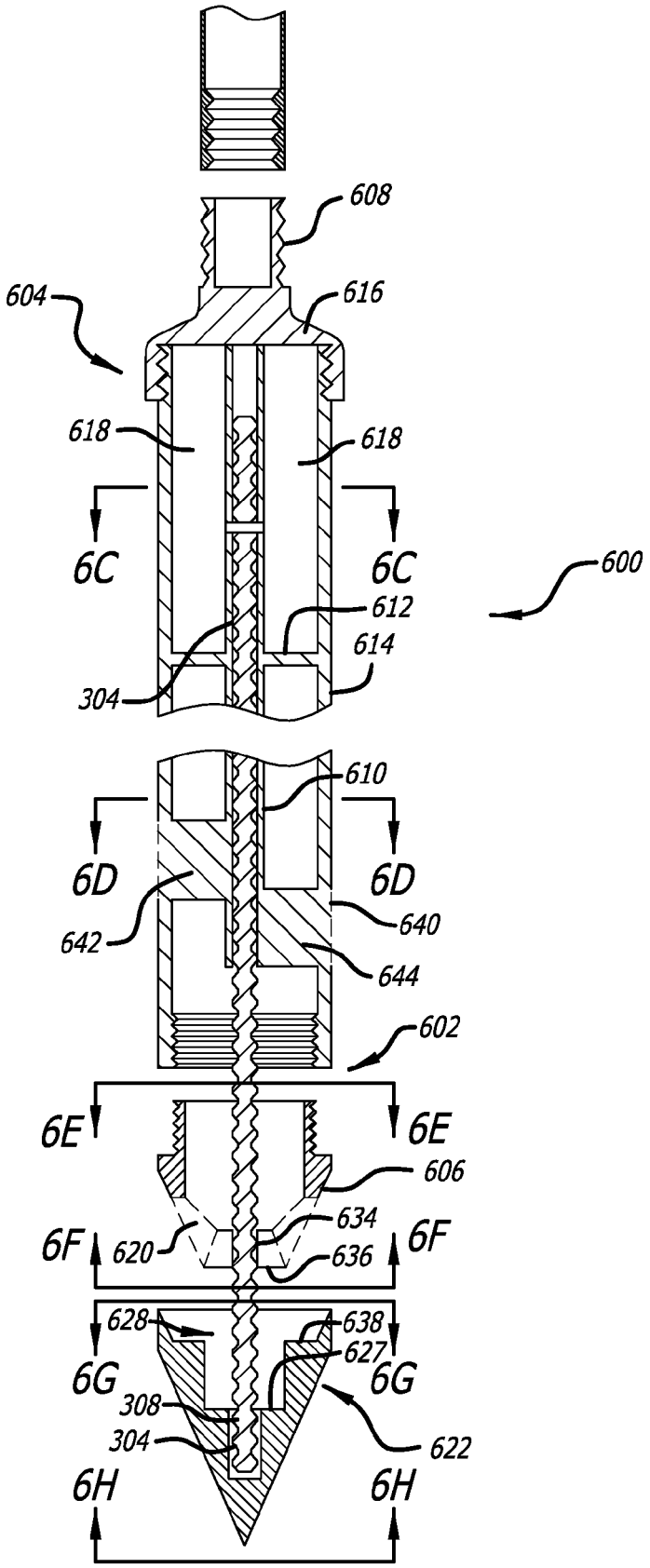
Figure 6C:
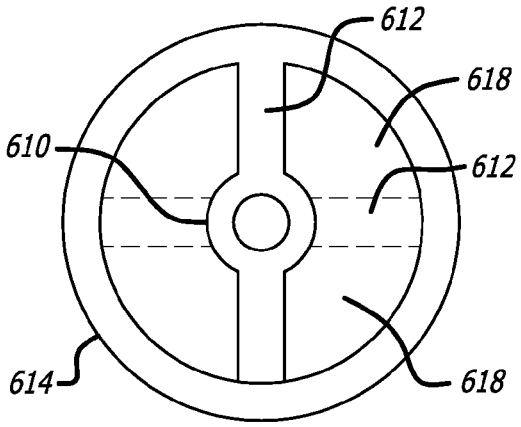
Figure 6D:
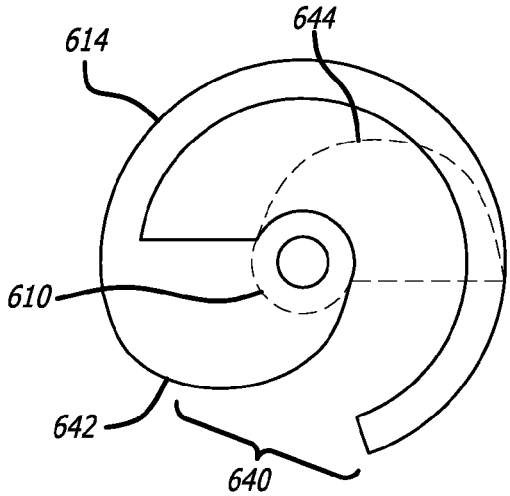
Figure 6E:
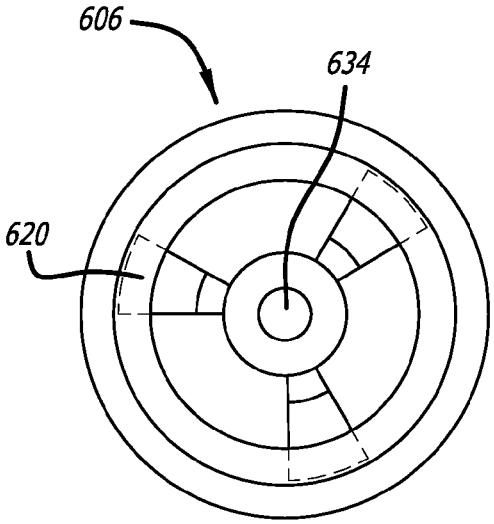
Figure 6F:
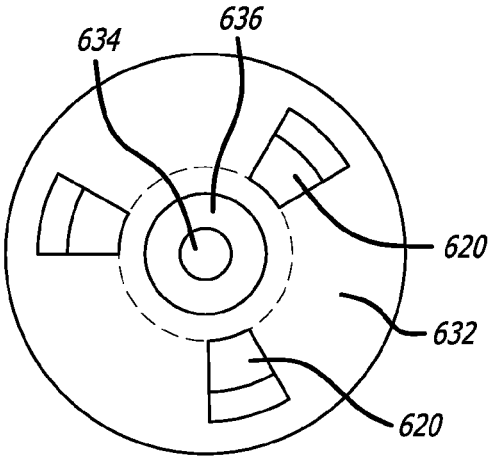
Figure 6G:
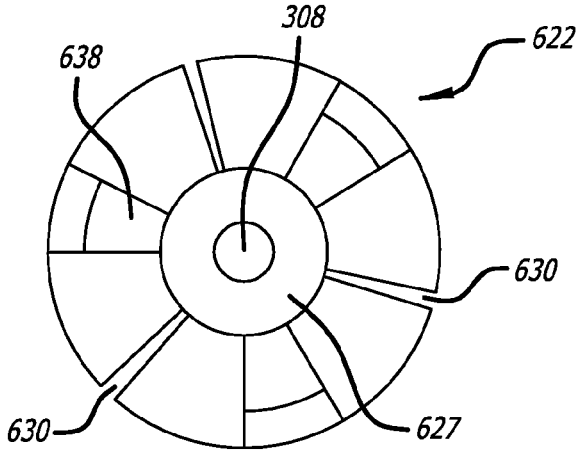
Figure 6H:
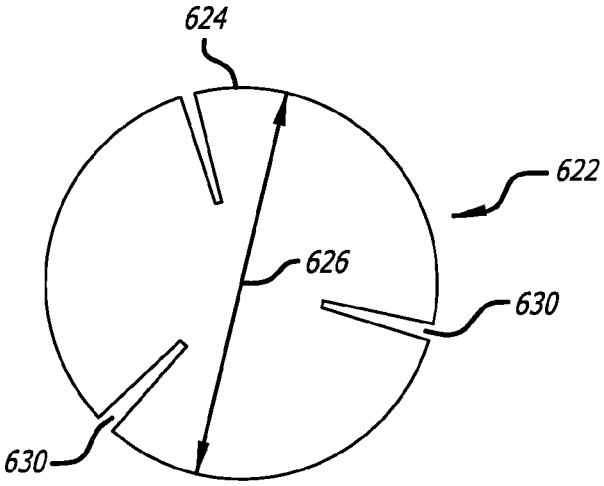
Figure 8E:
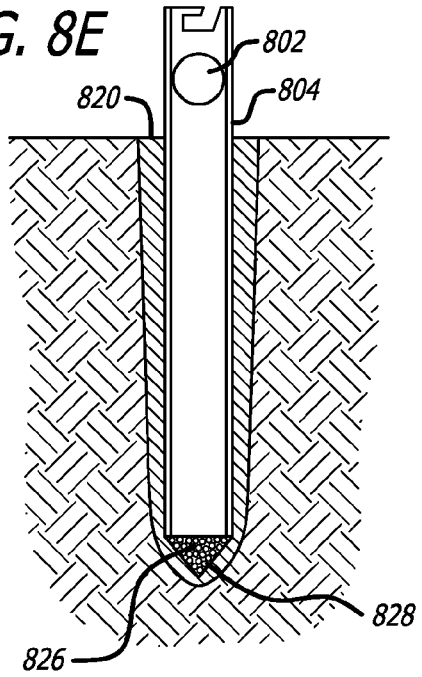
Figure 8F:
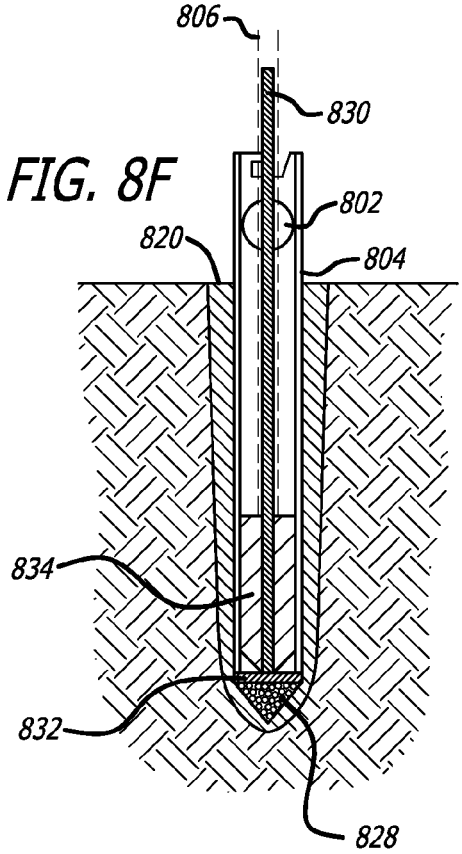
Figure 8G:
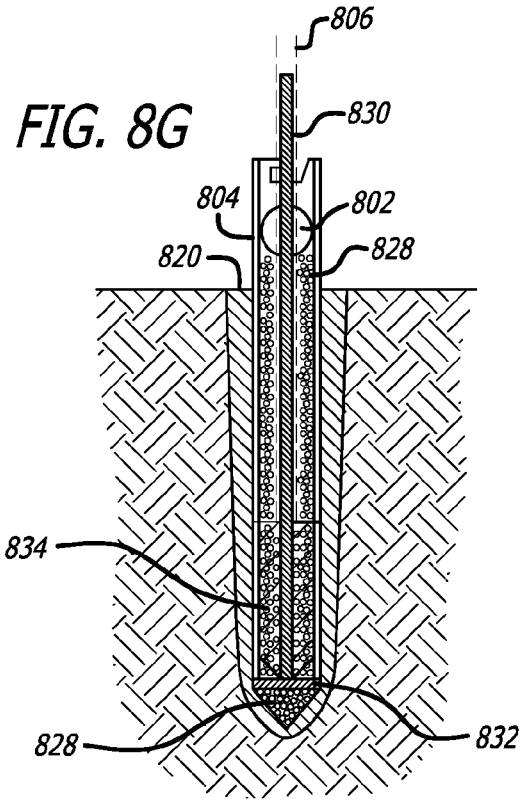

Then, as illustrated in FIG. 8E, aggregate 828 is added through port 802 to fill about the entirety of void 826. Next, as illustrated in FIG. 6F, tensioning rod 830 attached to reaction plate 832 are fitted into mandrel 834 which is inserted into the casing 804 and placed atop aggregate 828. Mandrel 834 can be sized to fit within casing within about 1/16 inch, about 1/8 inch, about 1/4, in about 1/2 inch, about 3/4 inch, or about 1 inch. Again, similar to FIG. 7G, additional aggregate can be added through port 802 to fill mandrel 834 and casing 804 up to port 802.

The load capacity of a pier system described herein can be dependent on the density and strength of the surrounding soil, the skin friction developed between the pier and the soil, and the diameter of the pier. Therefore, a combination of aggregate materials and in situ soil densification and compaction techniques can improve the system's surrounding soil load bearing capacity, expand the pier's base (belling), and simultaneously compact and densify the aggregate column increasing the pier's load capacity.

Mandrel 834 coupled with the sequence of construction steps described herein can simultaneously push soil into the side wall of a column and compact aggregate and soil using both rotational and compactive (axial) forces. The piers can be constructed using: non-corrosive, structurally efficient, light weight, structural and geotechnical materials, specially designed and engineered drilling tools and temporary casings, and a hydraulically powered "drifter" mounted on a 100 kW tracked drill rig that can provide both rotational 840 and compactive 848 forces to the tools that densify the soil, install and retract the casing, and displace the gravel into the pier's side wall while constructing the pier.

Mandrel 834 can be a mandrel as described in FIG. 4A-O, FIG. 5A-O, or 6QA-H.

As torque is applied to the mandrel, a normal force can be generated at a compaction element (e.g., compaction elements 436, 524, or 642) that displaces aggregate into the side wall of a column. The torque increases as the rotationally induced inter-particle friction creates additional aggregate drag and increasing column wall soil densification as the aggregate column diameter expands into the surrounding soil. Then, the casing and/or mandrel are incrementally withdrawn to continue the belling process at the next elevation. In one embodiment, the mandrel can be incrementally withdrawn once pre-stated minimum torque thresholds are exceeded. As the tool is raised, aggregate can fill the created void below via aggregate port which can then be compacted using drill equipment's crowd and hammer forces. Such a process will be explained in greater detail below.

Figure 8H:
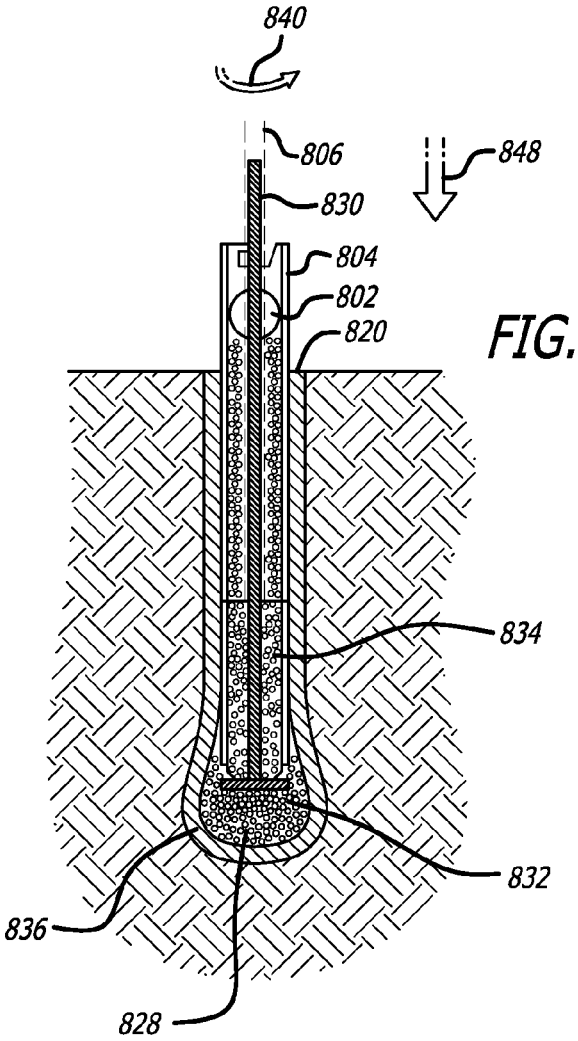

As illustrated in FIG. 8H, mandrel 834 is advanced using drilling equipment supplied crowd and hammer axial compactive force 848 to consolidate aggregate 828 at pier tip 836. Once mandrel 834 has exposed its horizontal ports (e.g., horizontal ports 440, 516, or 640) past the casing 804, optional rotation 840 of mandrel 834 commences in addition to the hammer force. As more axial 848 and torque 840 induced forces are applied by mandrel 834 to the aggregate, the pier tip 836 can become bulbous in shape.

Figure 8I:
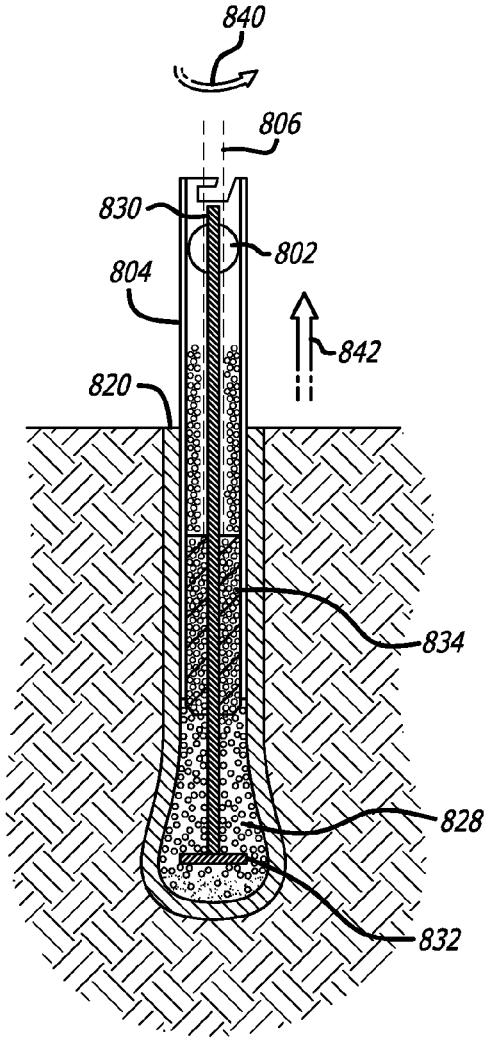
Figure 8J:
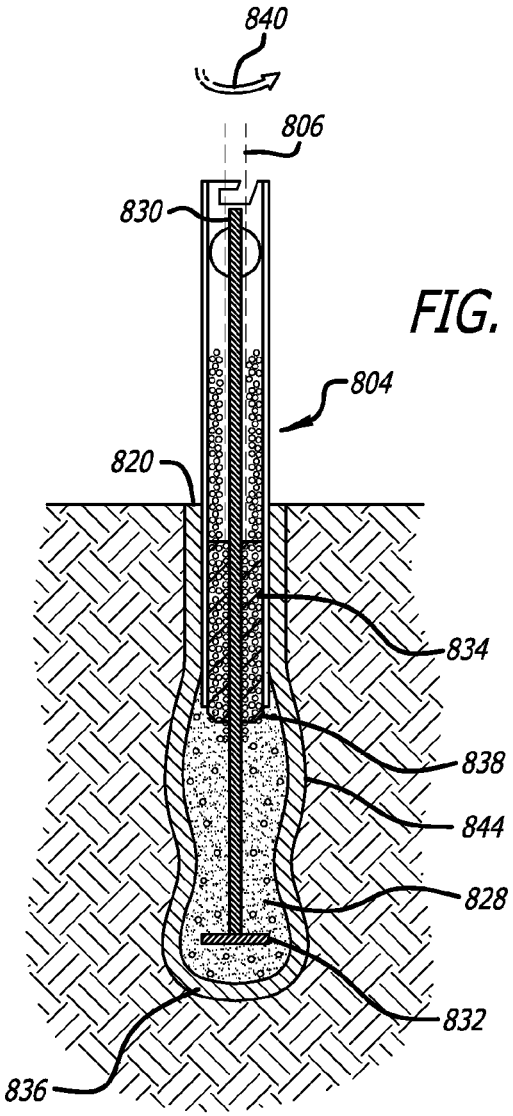

Mandrel 834 and casing 804 can then be concurrently lifted 842 in increments as illustrated in FIG. 8I. These increments can be about 2 inches, about 4 inches, about 6 inches, about 8 inches, about 10 inches, about 12 inches, about 18 inches, about 24 inches, about 30 inches, about 36 inches or more. Optional rotation 840 can continue as mandrel 834 and casing 804 are lifted. Mandrel 834 is then re-engaged with the aggregate 828 newly delivered to the void created as mandrel 834 and casing 804 are lifted. Subsequent lifts of mandrel 834 and casing 804 can be commenced followed by compaction and optional rotation forces. As is illustrated in FIG. 8J, second bulbous shape 844 can be created as both horizontal force and vertical force are applied by mandrel 834.

Figure 8K:
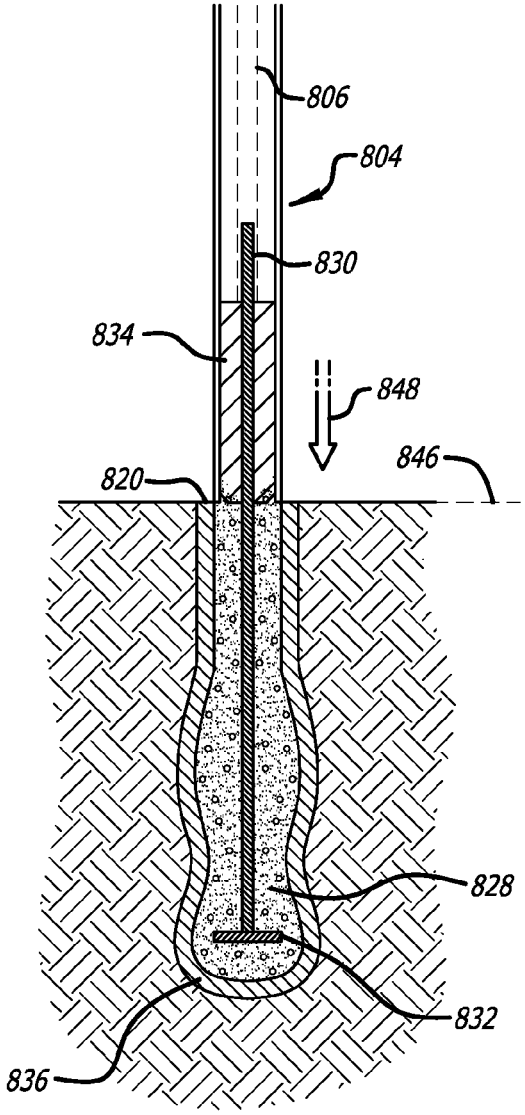
Figure 8L:
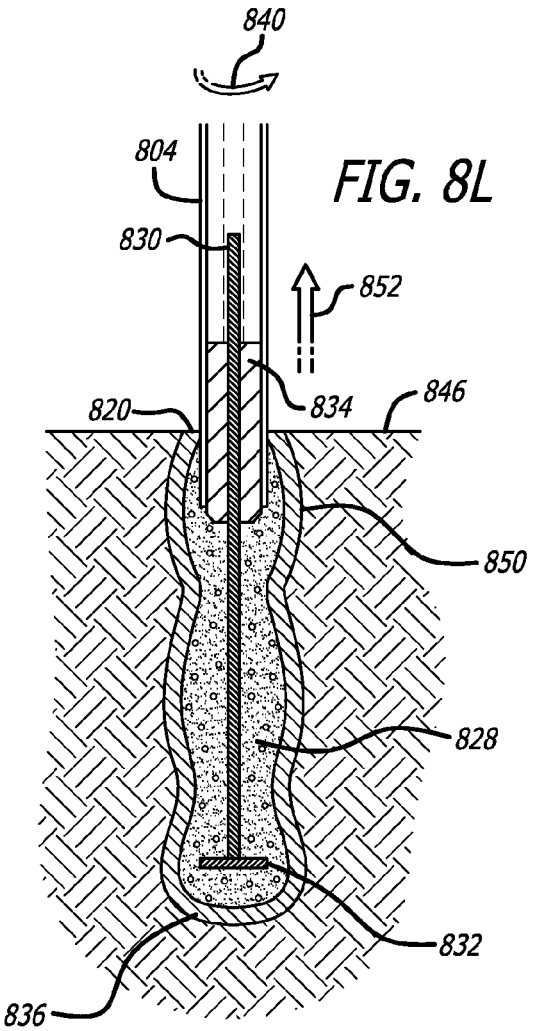

As illustrated in FIG. 8K, once pier aggregate height reaches ground level 846, compaction 848 of pier top is commenced. Again vertical hammering and optionally rotation are provided by mandrel 834. As mandrel 834 is advanced out of casing 804, a third bulb 850 can be created near ground level 846. After compaction is complete, as illustrated in FIG. 8L, mandrel 834 and casing 804 are removed 852 leaving tensioning rod 830 emanating from the surface. Tensioning rod 830 can optionally be threaded.

Figure 8M:
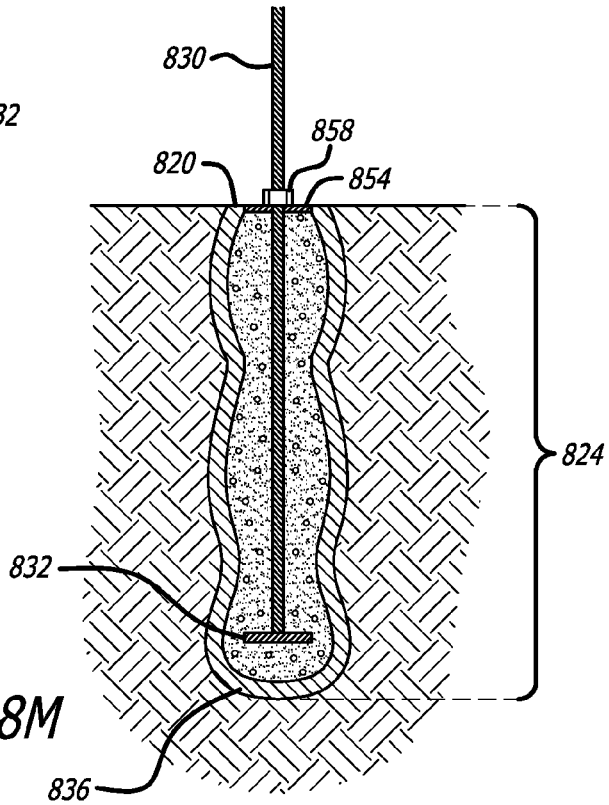

Second reaction plate 854, as illustrated in FIG. 8M, is then placed atop newly formed pier and secured using securing device 858. Second reaction plate can be similar or the same as reaction plate reaction plate 832 or can be different. For example, second reaction plate 854 can be a plate or large diameter washer made of precast concrete, GFRP, plastic, recycled materials, nylon, metal, composite, polymer, or any other strong, non-compressible, and semi-ductile composite material known in the art and formed to disperse the loads as long as the pier's column strength and the soils stressed state remains intact. Securing device can be a nut that is threaded on tensioning rod 830. In other embodiments, securing device can be welded or glued to tensioning rod 830.

Optionally, the formation of a column as described herein can be accomplished using a belling tool. In such an embodiment, a separate belling tool is used to create a bell at the bottom of the column and an axial compaction mandrel is used to compact the aggregate and build the remainder of the column. The bell is a bottom portion that can have a wider diameter than the rest of the column. Once a casing and shoe assembly has been hammered and rotated to an appropriate depth, a belling tool is inserted and driven just below the shoe. The belling tool is opened using an offset drive shaft and it is rotated around the circumference using the drill stem. This process causes the soil to be pushed out laterally, thus compacting the surrounding pier wall and creating a bigger void. Next, the bell tool is removed and the void is filled with gravel and compacted by the mandrel as described above.

The mandrels and, if used, temporary casings described herein can be sized appropriately for a particular application. For example, a foundation constructed in less dense organic material such as peat, a larger diameter mandrel (and accompanying casing) can be used to create a pier with equal bearing and tensile strengths as a smaller diameter pier constructed in more dense material, wherein a smaller diameter mandrel and casing can be used. Mandrel diameters in general range from about 3 inches to about 10 inches, from about 4 inches to about 12 inches, from about 6 inches to about 18 inches, from about 18 inches to about 24 inches, from about 24 inches to about 30 inches or from about 30 inches to about 36 inches. In one embodiment, the diameter of the mandrel is about 8 inches. The length of a mandrel can determine the depth of a foundation. Lengths can range from about 12 inches to about 18 inches, from about 18 inches to about 24 inches, from about 24 inches to about 30 inches, from about 30 inches to about 36 inches, from about 36 inches to about 42 inches, from about 42 inches to about 48 inches, from about 48 inches to about 54 inches, from about 54 inches to about 60 inches, from about 60 inches to about 66 inches, from about 66 inches to about 72 inches, from about 72 inches to about 78 inches, from about 78 inches to about 84 inches, from about 84 inches to about 90 inches, from about 90 inches to about 96 inches, from about 96 inches to about 102 inches, from about 102 inches to about 108 inches, or more.

In some embodiments, the foundation systems described can be easily decommissioned and are environmentally sustainable. For example, the post tension system or tensioning rod assembly comprised of the plates (e.g., a top plate and a bottom plate) and rod assembly are the only manmade products that might require removal upon decommission. This simple task is in comparison to large concrete foundations commonly used including imbedded rebar. Also, the foundations described can be exhumed in a single step and the materials recycled, disposed of, or even in some cases the aggregate reused in re-compacting/filling the removed pier's void.

Further, in some embodiments, the foundation systems can be installed without the need for elaborate machinery or materials. Such an arrangement can increase simplicity while reducing time and cost of a project. Again, all that may be needed is aggregate sized for a particular application, a reaction plate, a tensioning rod, and a mandrel and, if used, a temporary casing and mandrel matched pair. This simplicity is in contrast to common methods which require complex machinery and delivery systems, large, non-reusable parts for each foundation (e.g. corrosion protected steel piers or reinforced concrete footings), material removal (e.g. exhumed soil by an auger), material processing stations, lengthy set times (e.g. with concrete), and the like.

The foundations described herein can be used to anchor light to medium weight structures. From a plain weight standpoint, each foundation can sustain a compressive weight load of about 100 lbs, about 500 lbs, about 1,000 lbs, about 1,500 lbs, about 2,000 lbs, about 2,500 lbs, about 3,000 lbs, about 3,500 lbs, about 4,000 lbs, about 4,500 lbs, about 5,000 lbs, about 5,500 lbs, about 6,000 lbs, about 6,500 lbs, about 7,000 lbs, about 7,500 lbs, about 8,000 lbs, about 8,500 lbs, about 9,000 lbs, about 9,500 lbs about 10,000 lbs, about 11,000, about 11,500, about 12,000, about 12,500, about 13,000, about 13,500, about 14,000, about 14,500, about 15,000, about 15,500, about 16,000, about 16,500, about 17,000, about 17,500, about 18,000, about 18,500, about 19,000, about 19,500, about 20,000, between about 10,000 lbs and about 20,000 lbs, between about 5,000 lbs and about 15,000 lbs, between about 15,000 lbs and about 20,000 lbs, between about 100 lbs and about 20,000 lbs, between about 500 lbs and about 15,000 lbs, between about 10,000 lbs and about 15,000 lbs, at least about 100 lbs, at least about 200 lbs, at least about 500 lbs, at least about 1,000 lbs, at least about 5,000 lbs, or at least about 10,000 lbs. This weight number can change depending on the size and shape of the mounted structure(s). For example, wind can have a bearing on larger surface area structures. A skilled artisan understands the structural needs and can vary weight requirements with structure size and shape.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A post tensioned foundation installation system comprising a mandrel including a first end and a second end, the first end including a compaction element and the second end including a power tool attachment section;

a transversal rod guide conduit originating at the compaction element and terminating at or before the power tool attachment point;

an outer skin defining an aggregate feed cavity, wherein the outer skin includes at least one aggregate port; and a tension rod assembly having a tensioning rod and at least one reaction plate, wherein the compaction element includes at least one first torque transfer element.

2. The post tensioned foundation installation system according to claim 1, wherein the feed cavity includes at least one horizontal compaction element.

3. The post tensioned foundation installation system according to claim 1, wherein the tensioning rod is housed within the transversal rod guide and a bottom reaction plate rests against the compaction element.

4. The post tensioned foundation installation system according to claim 1, wherein the reaction plates are flat.

5. The post tensioned foundation installation system according to claim 1, wherein at least one of the reaction plates is conical.

6. The post tensioned foundation installation system according to claim 5, wherein a bottom reaction plate is threaded.

7. The post tensioned foundation installation system according to claim 1, wherein the tensioning rod is threaded.

8. The post tensioned foundation installation system according to claim 1, wherein at least one of the reaction plates includes a second torque transfer element that weds with the at least one first torque transfer element.

9. A post tensioned foundation installation system comprising a mandrel including an outer skin having a first end and second end, the first end including a first portion to attach compaction element and the second end including a second portion to attach drive adapter;

a transversal rod guide originating at first end, extending through the mandrel, and held in place by at least one transversal rod guide support;

at least one interior compaction element attached to the transversal rod guide and the outer skin to assist in compacting aggregate against the side wall of a column associated with at least one side aggregate port in the outer skin, wherein the at least one interior compaction element is curved downward in a spiral; and a tensioning rod and at least one reaction plate.

10. The post tensioned foundation installation system according to claim 9, wherein the tensioning rod is threaded.

* * * * *